US008960317B2

(12) United States Patent
Ayasse

(10) Patent No.: US 8,960,317 B2
(45) Date of Patent: Feb. 24, 2015

(54) HORIZONTAL WELL LINE-DRIVE OIL RECOVERY PROCESS

(75) Inventor: Conrad Ayasse, Calgary (CA)

(73) Assignee: Capri Petroleum Technologies Ltd., Calgary, Alberta ( * ) Notice: Subject to any disclaimer, the term of this patent is extended or adjusted under 35 U.S.C. 154(b) by 152 days.

(21) Appl. No.: 13/314,078

(22) Filed: Dec. 7, 2011

(65) Prior Publication Data

US 2013/0133884 A1 May 30, 2013

(30) Foreign Application Priority Data

Nov. 25, 2011 (CA) ..... 2759362
Nov. 25, 2011 (WO) ..... PCT/CA2011/001308

(51) Int. Cl.
*E21B 43/16* (2006.01)
*E21B 43/243* (2006.01)
*E21B 43/30* (2006.01)

(52) U.S. Cl.
CPC ..... *E21B 43/16* (2013.01); *E21B 43/243* (2013.01); *E21B 43/305* (2013.01)
USPC ..... 166/401; 166/266; 166/272.3

(58) Field of Classification Search
CPC ... E21B 43/2406; E21B 43/166; E21B 43/24; E21B 36/02; E21B 43/305; E21B 43/243; E21B 43/16
USPC ..... 166/250.06, 272.1, 272.3, 288, 302, 166/58–59
See application file for complete search history.

(56) References Cited

U.S. PATENT DOCUMENTS

2005/0072567 A1* 4/2005 Steele et al. ..... 166/272.3
2009/0139716 A1 6/2009 Brock et al.
2010/0012331 A1* 1/2010 Larter et al. ..... 166/401

FOREIGN PATENT DOCUMENTS

CA 2058255 6/1993
CA 2650130 A1 7/2009
WO WO2010043034 A1 4/2010

* cited by examiner

*Primary Examiner* — Yong-Suk (Philip) Ro
(74) *Attorney, Agent, or Firm* — Gowling Lafleur Henderson LLP; D. Doak Horne

(57) ABSTRACT

An in situ combustion process entailing the simultaneous production of liquids and combustion gases that combines fluid drive, gravity phase segregation and gravity drainage to produce hydrocarbons from a subterranean oil-bearing formation, comprising initially injecting gas, steam or a fluid through a horizontal well placed high in the formation, and initially producing hydrocarbons through a lower, parallel horizontal well. Thereafter, in accordance with the method, production from the lower well is ceased, and a gas, liquid, or steam injected into such lower well, and an adjacent parallel well likewise low in the reservoir is used to produce the oil. Significant portions of a reservoir may thereby be exploited by continually drilling lower adjacent horizontal wells in a direction along the reservoir and converting penultimate lower production wells into injection wells and thereby driving hydrocarbons to an adjacent parallel production well for recovery to surface. The process may further employ in-situ combustion.

23 Claims, 16 Drawing Sheets

Fig. 2 (iii)

Fig. 4a (ii)

Fig. 4a (iii)

Fig. 4b (ii)

Fig. 4b (iii)

Fig. 4c (ii)

Fig. 4c (iii)

HORIZONTAL WELL LINE-DRIVE OIL RECOVERY PROCESS

FIELD OF THE INVENTION

The present invention relates to an oil extraction process, and more particularly to a method of extracting oil from subterranean hydrocarbon deposits using horizontal wells.

BACKGROUND OF THE INVENTION

Steam-based oil recovery processes are commonly employed to recover heavy oil and bitumen. For example, steam-assisted-gravity-drainage (SAGD) and cyclic steam injection are used for the recovery of heavy oil and cold bitumen. When the oil is mobile as native oil or is rendered mobile by some in situ pre-treatment, the steam drive process may also be used. A serious drawback of steam processes is the inefficiency of generating steam at the surface because a considerable amount of the heat generated by the fuel is lost without providing useful heat in the reservoir. Roger Butler, in his book "Thermal Recovery of oil and Bitumen', p. 415, 416, estimates the thermal efficiency at each stage of the steam-injection process as follows: steam generator, 75-85%; transmission to the well, 75-95%' flow down the well to the reservoir, 80-95%; flow in the reservoir to the condensation front, 25-75%. It is necessary to keep the reservoir between the injector and the advancing condensation front at steam temperature so that the major energy transfer can occur from steam condensing at the oil face. In conclusion, 50% or more of the fuel energy can be lost before heat arrives at the oil face. The energy costs based on BTU in the reservoir are 2.6-4.4 times lower for air injection compared with steam injection. Several other drawbacks occur with steam-based oil recovery processes: natural gas may not be available to fire the steam boilers, fresh water may be scarce and clean-up of produced water for recycling to the boilers is expensive. In summary, steam-based oil recovery processes are thermally inefficient, expensive and environmentally unfriendly.

There are many well patterns that can be employed for the production of oil from subterranean reservoirs. Some of these use vertical wells or combine vertical and horizontal wells. Examples of pattern processes are the inverted 7-spot well pattern that has been employed for steam, solvent and combustion-based processes using vertical wells, and the staggered horizontal well pattern of U.S. Pat. No. 5,273,111 which has been employed (but limited to) a process using steam injection.

U.S. Pat. No. 5,626,191 discloses a repetitive method, termed "toe-to-heel" air injection (THAI™), whereby a horizontal well is subsequently converted to an air injection well to assist in mobilizing oil for recovery by an adjacent horizontal well, which is subsequently likewise converted into an air injection well, and the process repeated.

THAI™ is a registered trademark of ARCHON Technologies Ltd. of Calgary, Alberta for "Oil recovery services, namely, the recovery of oil from subterranean formations through in-situ combustion techniques and methodologies and oil upgrading catalysts"

U.S. Pat. No. 6,167,966 employs a water-flooding process employing a combination of vertical and horizontal wells.

U.S. Pat. No. 4,598,770 (Shu et al, 1986) discloses a steam-drive pattern process wherein alternating horizontal injection wells and horizontal production wells are all placed low in a reservoir. In situ combustion processes are not contemplated.

Joshi in Joshi, S. D., "A Review of Thermal oil Recovery Using Horizontal wells", *In Situ,* 11(2 & 3), 211-259 (1987), discloses a steam-based oil recovery process using staggered and vertically-displaced horizontal injection and production wells pattern. A major concern is the high heat loss to the cap rock when steam is injected at the top of the reservoir.

U.S. Pat. No. 5,273,111 (Brannan et al, 1993) teaches a steam-based pattern process for the recovery of mobile oil in a petroleum reservoir. A pattern of parallel offset horizontal wells are employed with the steam injectors. The horizontal sections of the injection wells are placed in the reservoir above the horizontal sections of the production wells, with the horizontal sections of the production wells being drilled into the reservoir at a point between the base of the reservoir and the midpoint of the reservoir. Steam is injected on a continuous basis through the upper injection wells, while oil is produced through the lower production wells. In situ combustion processes are not mentioned.

U.S. Pat. No. 5,803,171 (McCaffery et al, 1998) teaches an improvement of the Brennan patent wherein cyclic steam stimulation is used to achieve communication between the injector and producer prior to the application of continuous steam injection. In situ combustion processes are not mentioned.

U.S. Pat. No. 7,717,175 (Chung et al, 2010) discloses a solvent-based process utilizing horizontal well patterns where parallel wells are placed alternately higher and lower in a reservoir with the upper wells used for production of solvent-thinned oil and the lower wells for solvent injection. Gravity-induced oil-solvent mixing is induced by the counter-current flow of oil and solvent. The wells are provided with flow control devices to achieve uniform injection and production profiles along the wellbores. The devices compensate for pressure drop along the wellbores which can cause non-uniform distribution of fluids within the wellbore and reduce reservoir sweep efficiency. In situ combustion processes are not mentioned.

WO/2009/090477 (Xiai and Mauduit, 2009) discloses an in situ combustion pattern process wherein a series of vertical wells that are completed at the top are placed between horizontal producing wells that are specifically above an aquifer. This arrangement of wells is claimed to be utilizable for oil production in the presence of an aquifer.

US Patent Application 2010/0326656 (Menard, 2010) discloses a steam pattern process entailing the use of alternating horizontal injection and production wells wherein isolated zones of fluid egress and ingress are created along the respective wellbores in order to achieve homogeneous reservoir sweep. The alternating wellbores may be in the same vertical plane or alternating between low and high in the reservoir, as in U.S. Pat. No. 5,803,171. Hot vapour is injected in the upper wells (e.g. Steam).

Improved efficiency, shortened time on initial return on investment (ie quicker initial oil recovery rates to allow more immediate return on capital invested), and decreased initial capital cost, in various degrees, are each areas in the above methods which may be improved.

SUMMARY OF THE INVENTION

An ideal oil recovery processes for recovering oil from an underground reservoir has a high sweep efficiency, uses a free (no cost) and infinitely available injectant, requires no purchased fuel, generates heat precisely where it is needed—at the oil face, and scavenges heat from the reservoir where heating of a reservoir was used. Additionally, a high oil production rate, especially in the initial stage of the exploitation, is critical to the viability and/or profitability of an oil recovery process.

The present invention, a horizontal well line-drive process for recovery of oil from hydrocarbon-containing underground reservoirs, has two advantages over a "Staggered Well" pattern configuration of oil recovery, the latter being a non-public method of oil recovery conceived by the inventor herein and more fully disclosed below, which "Staggered Well" method in many respects is itself an improvement, in certain respects and to varying degrees, over the above prior art methods and configurations.

Specifically, for a comparable volumetric sweep area and identical total cumulative oil recovery in regard to a hydrocarbon-containing subterranean reservoir (formation), the horizontal well line-drive (hereinafter "HWLD") process of the present invention has been experimentally shown, as discussed herein, to provide a greater initial rate of recovery of oil than the "Staggered Well" method discussed herein. Thus a greater and more rapid initial return on investment for oil companies incurring large expenditures in developing subterranean reservoirs may be achieved. This is a significant advantage, since investment in developing oil reservoirs is very high, and the time in which a return on investment may be realized is frequently a very real and substantial consideration as to whether the investment in such a capital project is ever made in the first place.

In addition, the horizontal well line-drive process of the present invention, for a comparable volumetric sweep area and near identical total oil recovery, has been experimentally shown to require fewer wells than the "Staggered Well" configuration, thus significantly reducing the capital costs to an oil company to develop and produce oil from an underground hydrocarbon-containing formation.

Accordingly, by way of broad summary, in one broad embodiment of the HWLD oil recovery process of the present invention, a first horizontal well is drilled high in a subterranean hydrocarbon-containing reservoir, and a medium such as a gas is injected into the reservoir via perforations in a well liner in such first horizontal well. Oil, water and gas are co-produced via a second parallel laterally offset horizontal well, placed low in the reservoir. When the oil rate at the second horizontal (production) well falls below an economical limit, a third parallel horizontal well is drilled low in the reservoir laterally spaced apart from the second horizontal well, and used to produce oil, while at the same time the second horizontal well (initially a production well) is converted to an injection well, and such gas likewise injected into the formation via such second horizontal well so as to allow the combustion front to be continually supplied with oxidizing gas to permit continued progression of the combustion front and thus continued heating of oil ahead of the advancing combustion front, which drains downwardly and is collected by the horizontal wells drilled low in the formation ahead of (or at least below) the advancing combustion front. The steps of drilling further horizontal, parallel, laterally spaced apart wells low in the formation, and successively converting "exhausted" production wells to injection wells to further the recovery of oil from remaining production wells is continued in a substantially linear direction along the reservoir in order to exploit the reservoir in a single direction as a 'line-drive-process' that achieves high reservoir sweep efficiency. The injectant, if a gas, may be a solvent gas such as $CO_2$ or light hydrocarbon or mixtures thereof, steam or an oxidizing gas such as oxygen, air or mixtures thereof. Alternatively the injectant may be any mixture of solvent, steam or oxidizing gas. A favoured embodiment utilizes steam injectant and the most favoured embodiment utilizes oxidizing gas as the injected medium.

When the process utilizes oxidizing gas injectant and in situ combustion, it meets the commercial needs of relatively low energy costs and low operating costs by providing a novel and efficient method for recovering hydrocarbons from a subterranean formation containing mobile oil.

The distance between the parallel and offset horizontal well producers, as well as the well lengths, will depend upon specific reservoir properties and can be adequately optimized by a competent reservoir engineer. The lateral spacing of the horizontal wells can be 25-200 meters, preferably 50-150 meters and most preferably 75-125 meters. The length of the horizontal well segments can be 50-2000 meters, preferably 200-1000 meters and most preferably 400-800 meters.

In a homogeneous reservoir using the method of the present invention it is beneficial for high reservoir sweep efficiency to deliver the injectant equally to each perforation in the injection well liner and to compel equal fluid entry rates at each perforation at each perforation in the production well liner. Considering that horizontal wells typically have a 'toe' at the end of the horizontal segment, and a 'heel' where the horizontal segment joins the vertical segment, in a refinement of the present invention it is preferred to place the horizontal wells so that the heel of the injector (injection) well is opposite the toe of the adjacent laterally spaced apart producer (production) well so that "short-circuiting" of gas between injector and producer wells is minimized. Short circuiting otherwise occurs because the point of highest pressure in the injector well is at the heel since a pressure drop is typically incurred as the injectant is pumped under pressure and flows along the horizontal leg from heel to toe. Conversely, the point of highest pressure in a producer (production) well is at the toe, as gas and oil is typically drawn from the heel. Accordingly, it is preferred to have the heel of the injector well opposite the toe of the adjacent production well, so that high pressure (typically heated) gas is forced to travel a greater distance through the formation to the low pressure portion at the heel of the adjacent production well.

Alternatively, both the injection and production wells may be placed with the respective heel and toe portions in mutually juxtaposed position. In such case it is then preferred to use internal tubing to inject the gas at the toe of the injection well, thereby moving the high pressure source from the heel of the injection well to its toe. In such manner the high pressure source will be at an end of the reservoir opposite the low pressure heel of the production well, thereby forcing the gas to travel a longer distance through the formation and thereby more effectively free oil trapped in the formation, so as to then travel and be collected by the low pressure area at the heel of the production well. Such configuration has the benefit of requiring only a single drilling pad located on the same side of the reservoir, since the vertical portion of the injector wells and the producer wells will all be on the same side of the reservoir.

In addition to the employment of configurations which transpose (reverse) the respective heel and toe portions of adjacent horizontal wells or alternatively use internal tubing in the injector well, the uniform delivery of gas along the length of the injection well and uniform collection of oil along the production well may be obtained, or further enhanced, by varying the number and size of perforations along the well liner in an injector well, to balance the pressure drop along the well. A pressure-drop-correcting perforated tubing can be placed inside the primary liner of the injector well. This has the advantage of utilizing gas flow in the annular space to further assist the homogeneous delivery of gas. Alternatively, or in addition, similar methodologies may be applied to the production wells in order to more uniformly collect mobile oil along substantially the entire length of the production well, and assist in preventing "fingering" of injectant gas directly into production wells.

The outside diameter of the horizontal well liner segments can be 4 inches to 12 inches, but preferably 5-10 inches and most preferably 7-9 inches. The perforations in the horizontal segments can be slots, wire-wrapped screens, Facsrite™ screen plugs or other technologies that provide the desired degree of sand retention.

Facsrite™ is an unregistered trademark of Absolute Completion Technologies for well liners having sand screens therein.

The injected gas may be any oxidizing gas, including but not limited to, air, oxygen or mixtures thereof.

It is desirable to achieve equal gas injection rates along the injector well and equal fluid production rates along the horizontal production well in order to obtain the greatest reservoir sweep efficiency and uniform recovery. The maximum gas injection rate will be limited by the maximum gas injection pressure, which must be kept below the rock fracture pressure, and will be affected by the length of the horizontal wells, the reservoir rock permeability, fluid saturations and other factors.

The use of a numerical simulator such as that used in the Examples below is beneficial for confirming the operability and viability of the design of the present invention for a specific reservoir, and can be readily conducted by reservoir engineers skilled in the art.

Accordingly, and more particularly, in a first broad aspect of the method of the present invention, such method is directed to a method for recovering oil from a hydrocarbon-containing subterranean reservoir, comprising the steps of:

(i) drilling a first horizontal well, situated relatively high in said reservoir;

(ii) drilling a second horizontal well, situated relatively low in said reservoir and aligned substantially parallel to said first horizontal well;

(iii) injecting a medium comprising a gas, steam, or a liquid into said reservoir via apertures in said first horizontal well;

(iv) withdrawing oil which moves downwardly in said subterranean reservoir and flows into said second horizontal well, from said second horizontal well;

(v) drilling a third horizontal well, relatively low in said reservoir and substantially parallel to said first and second horizontal wells but laterally spaced apart therefrom, laterally spaced farther from said first horizontal well than from said second horizontal well;

(vi) temporarily or permanently ceasing withdrawing hydrocarbons from said second horizontal well and proceeding to inject a second medium comprising a gas, steam, or a liquid into said second horizontal well; and (vii) withdrawing oil which moves downwardly in said subterranean reservoir into said third horizontal well, from said third horizontal well.

Each of said second, third, and further subsequently-drilled horizontal wells are all preferably co-planar with each other, but not with said first well, and laterally spaced from one another.

In order to make use of the "line drive" aspect of the invention and allow a sweeping of a significant volume of oil from within a substantially-sized hydrocarbon-containing reservoir, such method further comprises additional repeated steps to allow a progressive "sweep" in a generally linear direction along said formation, including the further steps of:

successively drilling additional horizontal wells low in said reservoir substantially parallel to and substantially co-planar with the third horizontal well but laterally spaced apart therefrom and from each other; and successively converting penultimate wells of said additional horizontal wells from a production well to an injection well for injecting said gas, steam, or a liquid so as to cause oil in said reservoir to move from within said reservoir downwardly into a last of said additional horizontal wells.

In a preferred embodiment, the first medium and the second medium are one and the same medium. In a further preferred embodiment, such medium is a gas which is soluable in the oil. Alternatively, the medium is a gas, namely CO2, light hydrocarbons, or mixtures thereof.

In yet a further preferred embodiment such medium comprises oxygen gas, air, or mixtures thereof for the purpose of conducting in situ combustion, and said method further comprises the step, after step (iii), of igniting hydrocarbons in the reservoir in a region proximate the first horizontal well, and withdrawing oil and combustion by-products from the subterranean formation via the second well and/or simultaneously or subsequently via the third well. The step of igniting the hydrocarbons and withdrawing combustion by-products and oil via said second horizontal well and/or said third horizontal well causes a combustion front to move laterally from said first horizontal well in the direction of said second and third horizontal wells, thereby heating oil in said reservoir and causing said oil to drain downwardly for collection by said second and/or third horizontal wells.

Accordingly, in a most preferred embodiment of the HWLD method of the present invention for recovering oil from a hydrocarbon-containing subterranean reservoir, such method comprises:

(i) drilling a first horizontal well relatively high in said reservoir, having a plurality of apertures along a length of said first well;

(ii) drilling a second horizontal well relatively low in said reservoir and substantially parallel to said first horizontal well;

(iii) injecting an oxidizing gas into said first horizontal well and into said reservoir via said apertures, for purposes of conducting in situ combustion in said reservoir;

(iv) igniting hydrocarbons in said reservoir;

(v) withdrawing oil which drains downwardly in said subterranean reservoir into said second horizontal well from said second horizontal well;

(vi) drilling a third horizontal well, relatively low in said reservoir and substantially parallel to said second horizontal well but laterally spaced apart therefrom and laterally spaced from said first injection well farther than from said second injection well;

(vii) temporarily or permanently ceasing producing hydrocarbons from said second horizontal well;

(viii) injecting said oxidizing gas into said second horizontal well; and (ix) withdrawing oil which drains downwardly in said subterranean reservoir into said third horizontal well, from said third horizontal well.

Where oxidizing gas is used as the injected medium, for the purposes of conducting in situ combustion, combustion ignition (ie step (iv) above) can be accomplished by various means well known to those skilled in the art, such as preheating the near-wellbore oil with hot fluids such as steam or the injection of spontaneously ignitable fluid such as linseed oil prior to injection of oxidizing gas. In this case, hot nitrogen (400° C.) was injected at the rate of 16,667 $m^3$/d for one month prior to switching to air at 100° C. The air does not have to be heated at the surface: it is heated by the act compression.

As mentioned above, to ensure high pressure ends of an injector well are not situated immediately adjacent the lowest pressure point (ie the heel portion) of an adjacent producer well thus giving rise to "short circuiting" or "fingering" of high pressure gas directly to the heel portion of the production well, in a preferred embodiment said step (iii) of injecting a gas, steam, or liquid into said first horizontal well comprises the step of injecting said gas, steam, or liquid into one end of said first horizontal well, and said step of withdrawing oil from said second horizontal well comprises the step of withdrawing said oil from one end of said second well, said one end of said second well situated on a side of said reservoir opposite a side thereof at which said one end of said first horizontal well is situated. Such configuration allows more uniform injection of such gas into the formation and reduces (and preferably avoids) "fingering" ("short-circuiting") of high pressure gas directly from the injector well to the production well.

Such approach may likewise be adopted not only with regard to the first and second wells, but also with regard to the second well relative to the third, and so on. For example, with regard to the arrangement of the second well relative to the third well, said step of injecting said gas, steam, or liquid into said second horizontal well may comprise the step of injecting said gas, steam, or liquid into an end of said second horizontal well situated on a side of said reservoir opposite an end of said third horizontal well from which said oil is collected from. In other words, proximal ends of mutually adjacent wells may be situated on mutually opposite sides of said reservoir.

Alternatively, the first end of each of the second well and third well may be situated on the same side of the reservoir. In such case, to reduce or avoid the "fingering" problem, said step of injecting said gas, steam, or liquid into said second horizontal well comprises injecting said gas, steam, or liquid into a second end of said second well via tubing, which tubing extends internally within said second well substantially from said first end to said second end of said second well.

Alternatively, where a first end of each of said second and third horizontal wells are located on a same side of said reservoir, said step of injecting said gas, steam, or liquid into said second horizontal well may comprise injecting said gas, steam, or liquid into said first end of said second well, and said step of withdrawing oil from said third well comprises withdrawing such oil from a second end of said third well via tubing, said tubing extending internally within said third well from said first end to substantially said second end of said third well.

Alternatively, or in addition, to avoid or reduce "fingering" of high pressure gas from an injection well to a production well, such as from the first horizontal injector well to the second well when such second well acts as a producer well, in one embodiment the first horizontal well has a well liner in which said plurality of apertures are situated, and a size of said apertures or a number of said apertures within said liner within said first horizontal well progressively increase from a first end to a second end of said first horizontal well.

Likewise, progressive increase in aperture size or number of apertures along the length of well liners in each of second, third, or subsequent wells may likewise be utilized. In such manner, by having larger or more numerous apertures at one end of a well than at another, pressure (and thus flow) can be more uniform over the length of the well, or even made higher at one end than another, and provided an adjacent well similarly employs progressive variation in an opposite direction, direct "short-circuiting" of gas from an injector well to an adjacent production well can be reduced or avoided. Instead, cross-flow of gas through the formation is thereby inducted to better expose the (typically high temperature) gas to more oil in the formation, thus increasing recovery rate of oil from the formation.

BRIEF DESCRIPTION OF THE DRAWINGS

In the accompanying drawings, which illustrate one or more exemplary embodiments and are not to be construed as limiting the invention to these depicted embodiments.

DETAILED DESCRIPTION OF PREFERRED EMBODIMENTS

Figure 1:
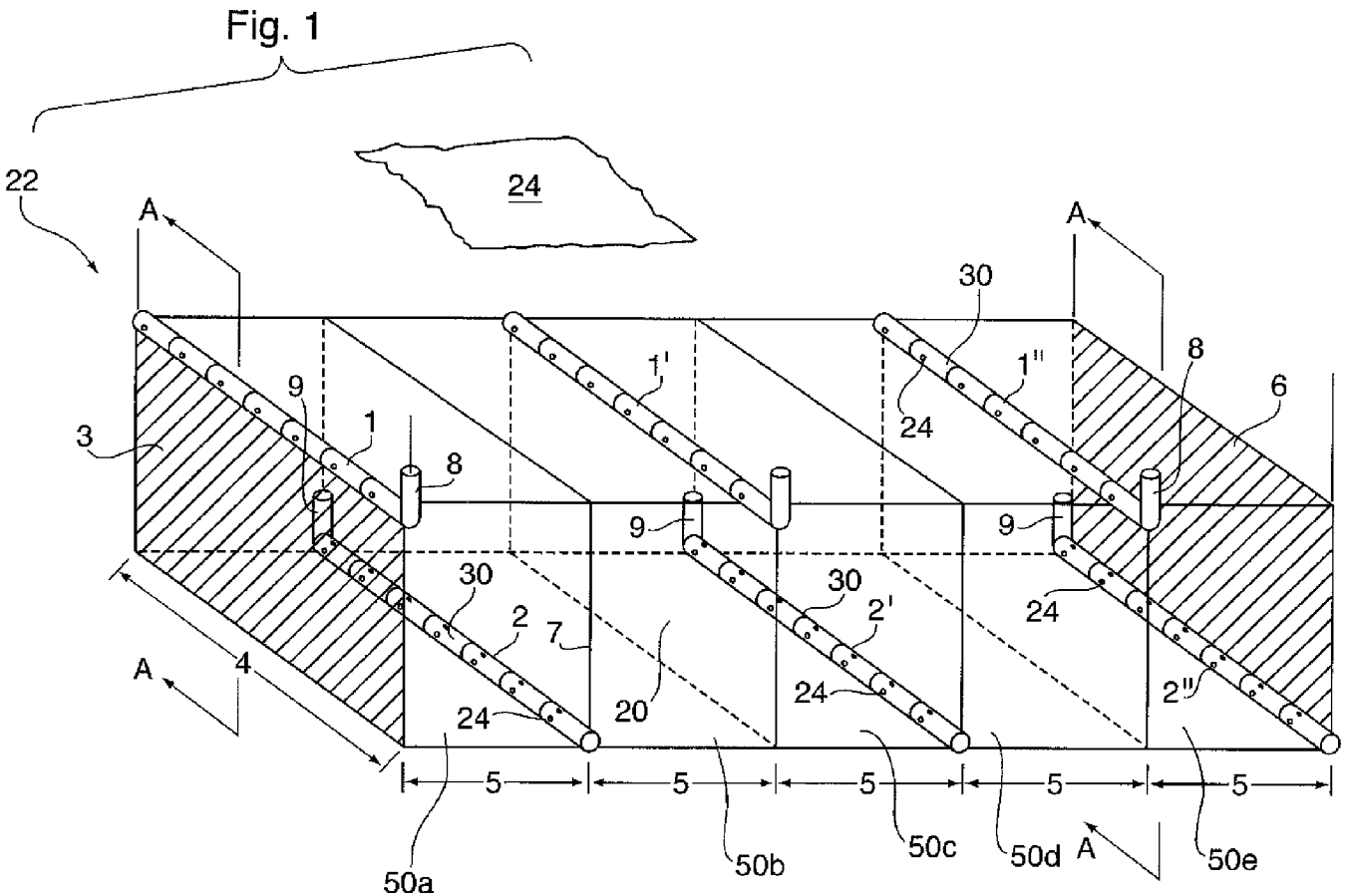
FIG. 1 shows a perspective schematic view of a subterranean hydrocarbon-containing reservoir of the "staggered well" configuration, having a plurality of horizontal injection wells located high in the reservoir and a plurality of alternatingly-spaced horizontal production wells situated low in the reservoir.
Figure 1A:
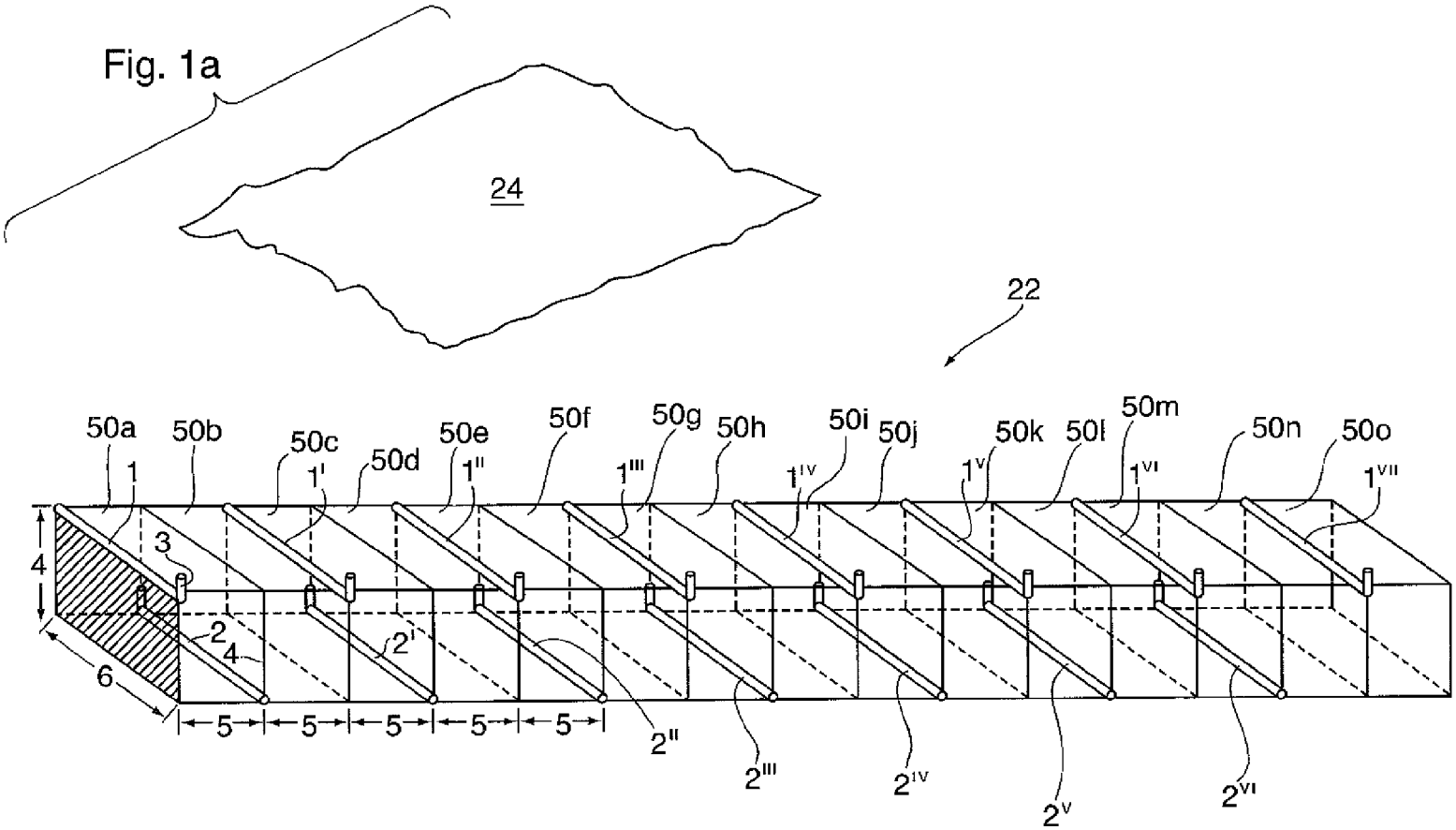
FIG. 1*a* shows a similar perspective schematic view of a subterranean hydrocarbon-containing reservoir of the "staggered well" configuration, to show the model used in Example 1 of the computer simulation, and which produced the experimental test results (line "B") of FIG. 5.

FIGS. 1 & 1*a* show a developed hydrocarbon-containing subterranean formation/reservoir 22 of the "staggered well" (hereinafter "Staggered Well" configuration), which does not form part of the invention claimed herein but forms subject matter of another application of the undersigned inventor, such other application being commonly assigned with the present invention.

In such "Staggered Well" configuration, parallel horizontal injection wells 1, 1', & 1" of each of length 6 are placed parallel to each other in mutually spaced relation, all situated high in a hydrocarbon-containing portion 20 of subterranean formation/reservoir 22 of thickness 4, situated below ground-level surface 24. Parallel horizontal, spaced apart production wells 2, 2' & 2" of similar length 6 are respectively placed low in the reservoir 22, midway between respective injection wells 1, 1', and 1", to make a well pattern array of staggered and laterally separated parallel and alternating horizontal gas injection wells 1, 1', & 1" and fluid production wells 2, 2' & 2", as shown in FIGS. 1 and 1*a*.

The hydrocarbon-containing reservoir 22 shown in FIG. 1 possesses two and one-half injection wells 1, 1', & 1" (edge injection well 1 and edge production well 2" each respectively constituting one-half well) for a total of five horizontal wells in the pattern. Conducting three repetitions of the method of FIG. 1 requires fifteen horizontal wells, as shown in FIG. 1*a*.

The lateral spacing 5 of the injection wells 1, 1', & 1" and production wells 2, 2' & 2" is preferably uniform.

In a preferred embodiment shown in FIGS. 1, 1*a*, the vertical segments 8 of the horizontal injection wells 1, 1' & 1" are at opposite ends compared with the vertical segments 9 of the horizontal production wells 2, 2' & 2". The vertical segments 8 of the injection wells 1, 1', & 1" are offset by the well width 6 from the vertical segments 9 of the production wells. This is to minimize short-circuiting of injection gas into the production wells 1, 1', & 1" as explained above. The pattern shown can be extended indefinitely away from the face 3 and/or the face 6 as desired to cover a specific volume of oil reservoir 22. For example, for a channel deposit the pattern could extend across the width of the channel. In additional phases of reservoir 22 development, additional arrays are placed adjacent to the first array, and so on, eventually exploiting the entire reservoir 22.

Referring to FIG. 1, a preferred embodiment of the invention horizontal injector wells 1, 1' & 1" and production wells 2, 2' & 2" which are simultaneously drilled, each possess well liner segments 30 situated in each of horizontal wells 1, 1', & 1" and 2, 2' & 2" which contain apertures 24, from which a medium such as an oxidizing gas, air, oxygen alone or in combination with carbon dioxide or steam, steam alone, or a diluent such as a hydrocarbon diluent, or combinations thereof, may be injected into the hydrocarbon-containing portion 20 via an injector well 1, 1', & 1", and through which oil may be allowed to flow through to collect in a horizontal production well 2, 2' & 2". In the case of horizontal production wells 2, 2' & 2", such well liners 30 and the apertures 24 therein may take the form of slotted liners, wire-wrapped screens, Facsrite™ screen plug, or combinations thereof, to reduce the flow of sand and other undesirable substances such as drill cuttings, from within the formation 22 into the production wells 2, 2' & 2".

Figure 2:
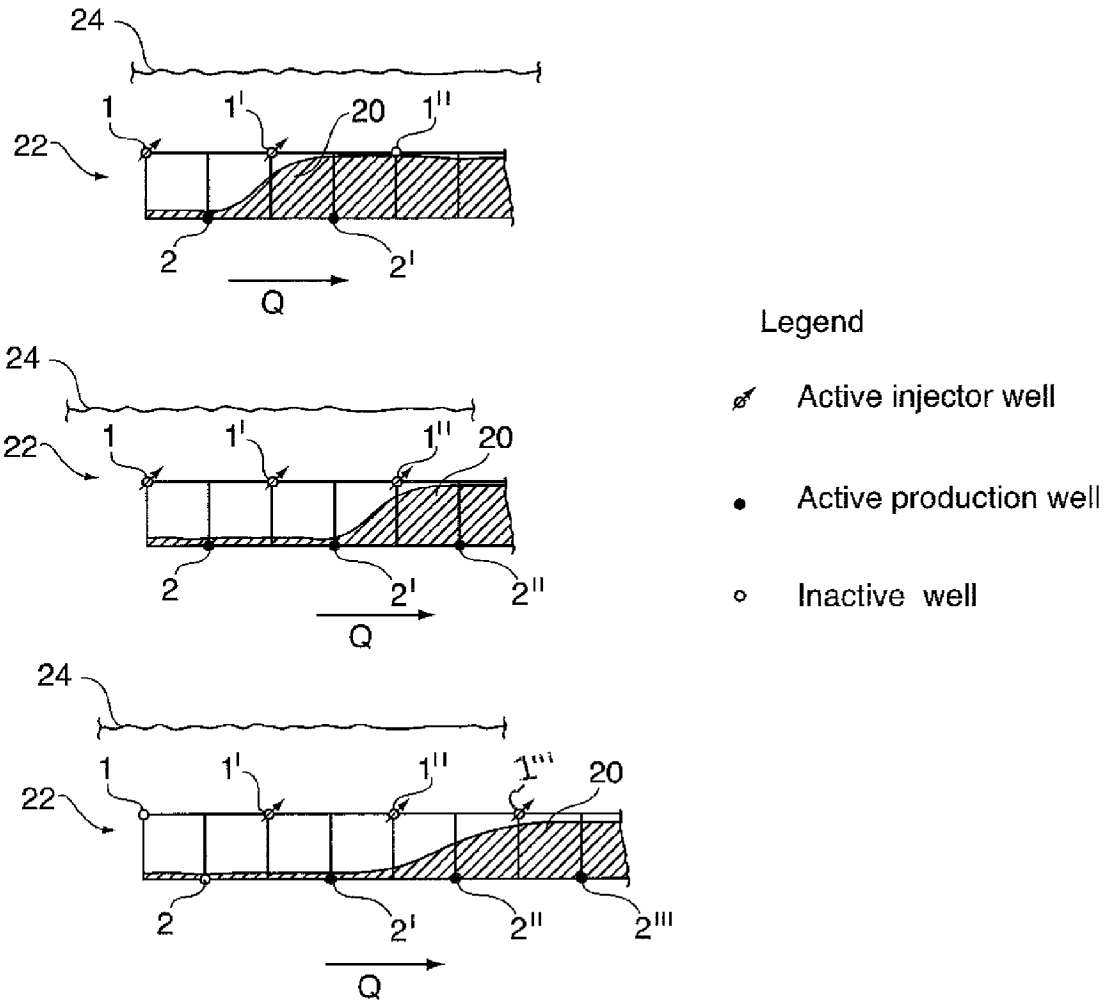
FIG. 2 (*i*)-(*iii*) are views on section A-A of FIG. 1, at various time intervals, showing a variation of the Staggered Well method of producing oil, which may optionally use a line drive of oil recovery in the direction of arrow "Q"

In the "Staggered Well" configuration of FIGS. 1, 1*a*, & 2, a medium such as an oxidizing gas, air, oxygen alone or in combination with carbon dioxide or steam, steam alone, or a diluent such as a hydrocarbon diluent, or combinations thereof, is injected into formation 22 via apertures in horizontal injector wells 1, 1', & 1", to cause mobility of oil in the oil-containing portion 20 of formation 22. Such oil flows downwardly within formation 22, and is collected in horizontal collector wells 2, 2' & 2".

The Staggered Well method, in one embodiment, may alternatively utilize a line drive configuration, such method shown in FIG. 2 (*i*)-(*iii*), in which three phases are implemented. In this regard, FIG. 2 shows views on section A-A of FIG. 1, at successive respective time intervals (i), (ii), & (iii), showing a method of causing a line drive of oil recovery in the direction "Q" using such "Staggered Well" configuration. Specifically, as seen from the first phase [FIG. 2 (*i*)], the injector well 1, and producer well 2 and 2' are first drilled, and production from wells 2 and 2' commenced. Thereafter in a second phase [FIG. 2(*ii*)], a third injector 1" and a third producer 2" are drilled, and injection and production commenced respectively in regard to such wells. In a third phase, a fourth injector 1'" and a fourth producer 2'" are drilled, with production ceasing from production well 2, and injection and production commenced in injection well 1'" and production well 2' respectively. The process may be continued indefinitely as shown in FIG. 1*a*, until reaching an end of reservoir 22.

Alternatively, as mentioned above, such "Staggered Well" method may simply consist of simultaneously drilling a set number of injector wells (eg. such as three wells 1, 1', & 1") and a corresponding number of producer wells (eg. such as three wells 2, 2' & 2") so as to produce the "pattern" of staggered wells of wells 1, 1', & 1" and 2, 2' & 2" shown in FIG. 1. Such pattern may be repeated as necessary, as shown in FIG. 1*a*. This method was used in the Examples (discussed below), for comparing the HWLD configuration and method to the Staggered Well configuration, using simultaneous drilling of five wells as discussed above.

Figure 3:
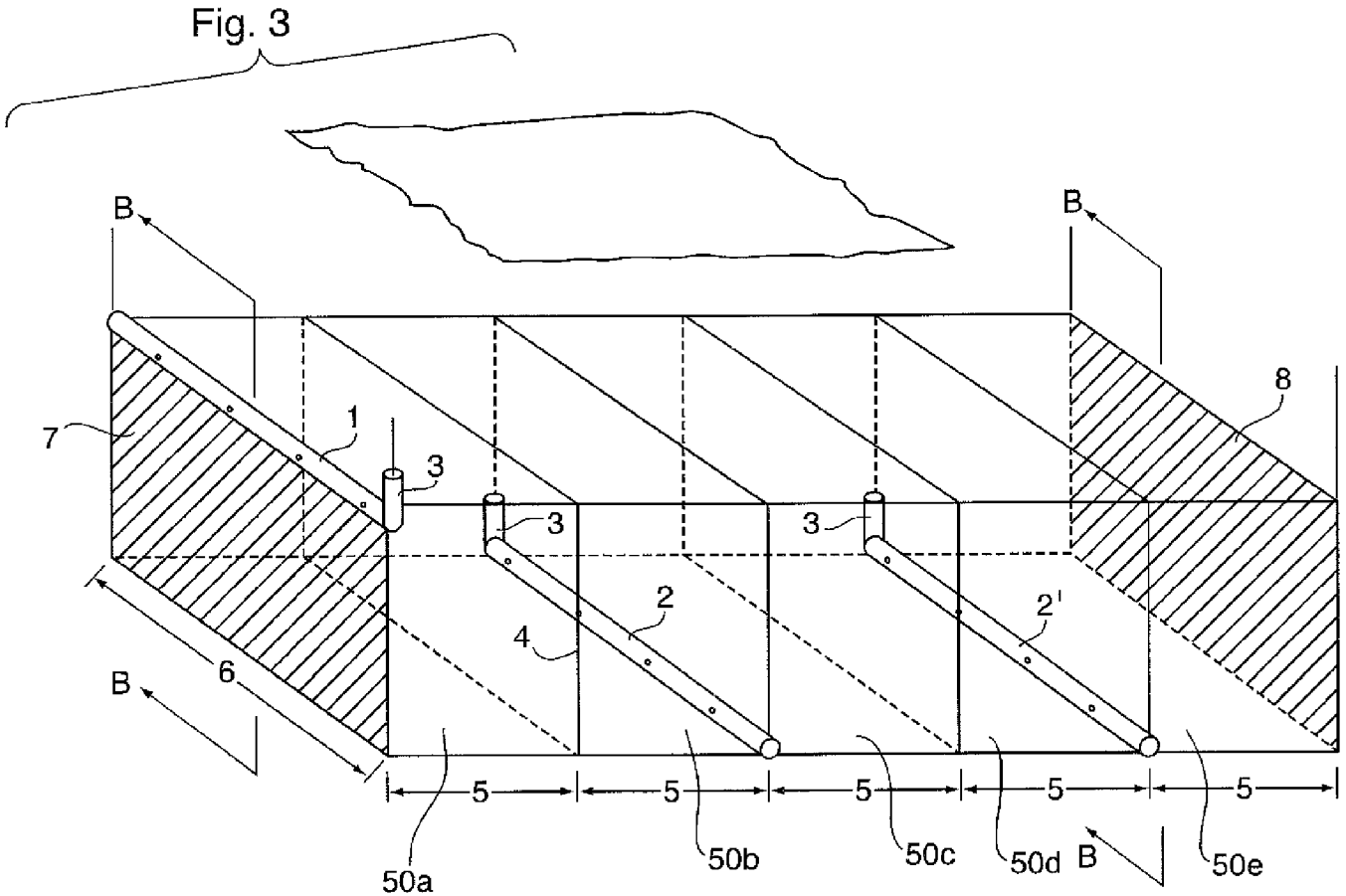
FIG. 3 shows a perspective schematic view of a subterranean hydrocarbon-containing reservoir of the horizontal well line drive ("HWLD") configuration of the present invention, having a first horizontal well located high in the reservoir, and a plurality of spaced horizontal production wells situated low in the reservoir.
Figure 6:
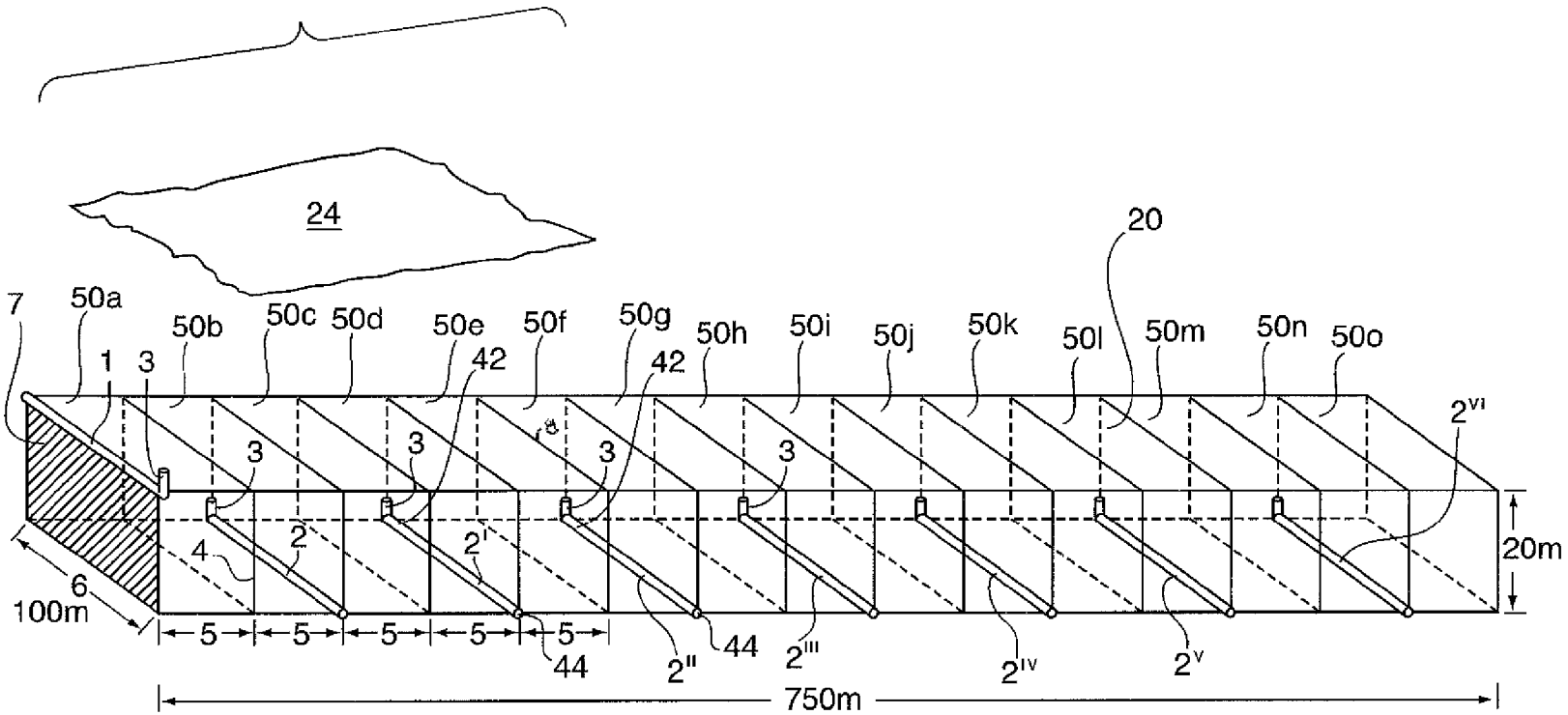
FIG. 6 is a perspective schematic view of a subterranean hydrocarbon-containing reservoir of the "horizontal well line drive" configuration of the present invention similar to FIG. 3.

FIGS. 3, 6 & FIGS. 4*a*-4*c* shows an alternative well arrangement/configuration (FIG. 3,6) and method (FIGS. 4*a*-4*c*) for recovery of oil from a reservoir 22 namely the horizontal well line drive ("HWLD") configuration and method respectively of the present invention, to develop an oil bearing portion 20 of a reservoir 22 of a thickness 4, a width 6, and which comprises a plurality of segments 50*a*-50*o* each of length 5 consecutively positioned commencing from plane 7 and progressing to the right of the page, as shown in FIGS. 3 and 6.

In such HWLD configuration and method, a first horizontal injection well 1 is drilled high within oil-containing portion 20 of reservoir 22, along edge 7, and a second parallel horizontal well 2 is drilled low in oil-containing portion 20 of reservoir 22, laterally spaced apart from first injector well 1.

Horizontal wells 2 & 2' have vertical portions 3 at each of their respective heel portions 42 which extend to surface 24. The distance separating planes 7 and 8 represent the edges of the oil-swept volume of oil containing portion 20 of reservoir 22 in a first phase of the method of the present invention.

Figure 11:
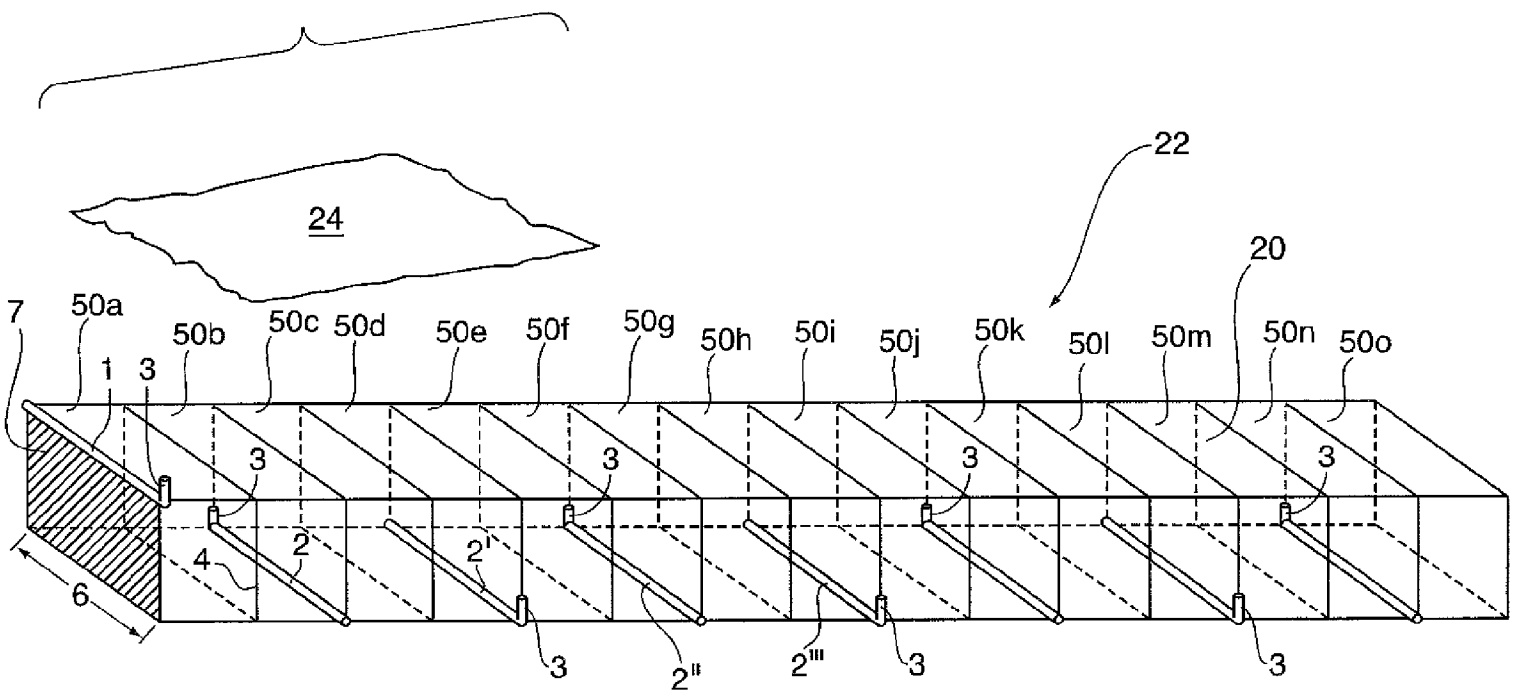
FIG. 11 is a perspective schematic view of a subterranean hydrocarbon-containing reservoir similar to FIG. 6, showing a modified "horizontal well line drive" configuration of the present invention, and which configuration produced the experimental test results (line "A") of FIG. 5.

In the embodiment of the HWLD method shown in FIG. 11, the position of vertical segment 3 of first injection well 1 is offset by the well length 6 from the vertical segments 3 of the production wells 2 & 2'. This is to minimize short-circuiting of injection gas into the production wells as explained above. The pattern shown can be extended indefinitely away from the face 7 and/or the face 8 as desired to cover a specific volume of oil reservoir 22. For example, for a channel deposit it could extend across the width of the channel. In additional phases of development of reservoir 22 as shown for example in FIG. 6, additional wells 2", 2''', $2^{iv}$ are drilled, laterally offset from the earlier drilled horizontal well 2', so as to eventually exploit the entire reservoir 22 along a length thereof.

Figure 4A:
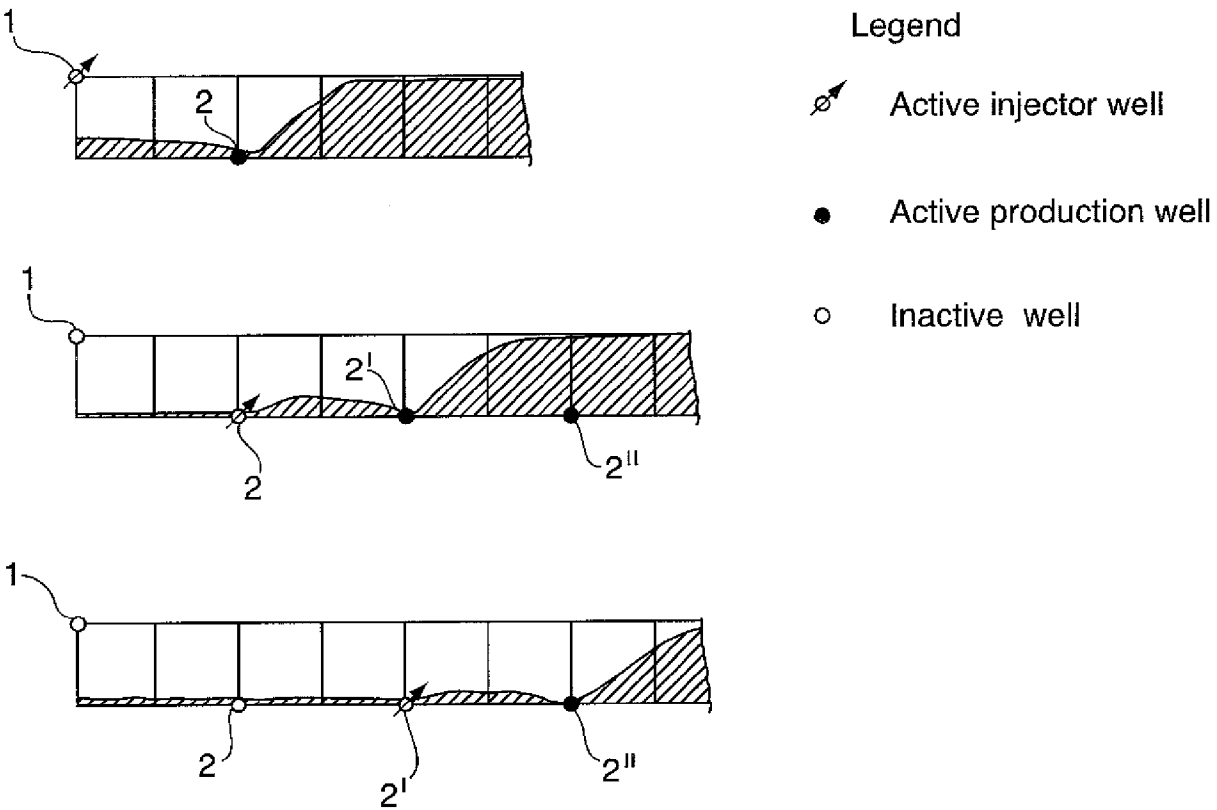
FIG. 4*a* (*i*)-(*iii*) are views on section B-B of FIG. 3, at successive time intervals, showing a method of producing oil using such "horizontal well line drive" configuration, showing the method for causing a line drive of oil recovery in the direction "Q"
Figure 4B:
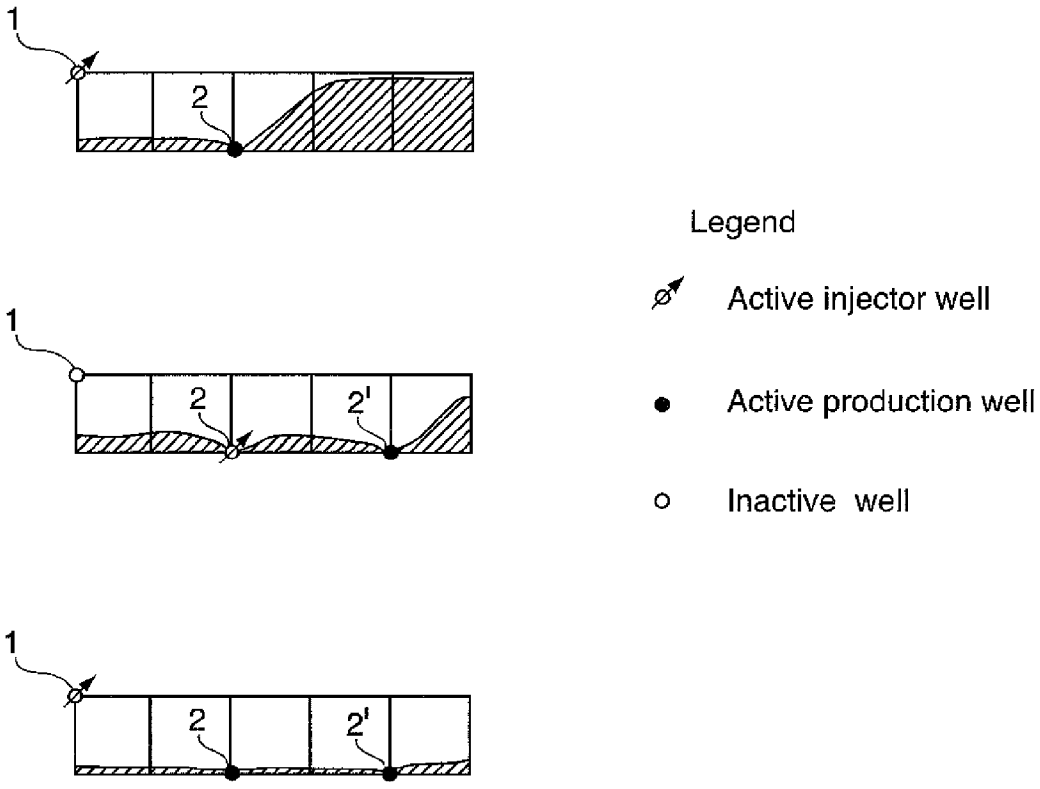
FIG. 4*b* (*i*)-(*iii*) are views on section B-B of FIG. 3, at successive time intervals, showing a modified method of producing oil using such "horizontal well line drive" configuration, showing the method for causing a line drive of oil recovery in the direction "Q"
Figure 4C:
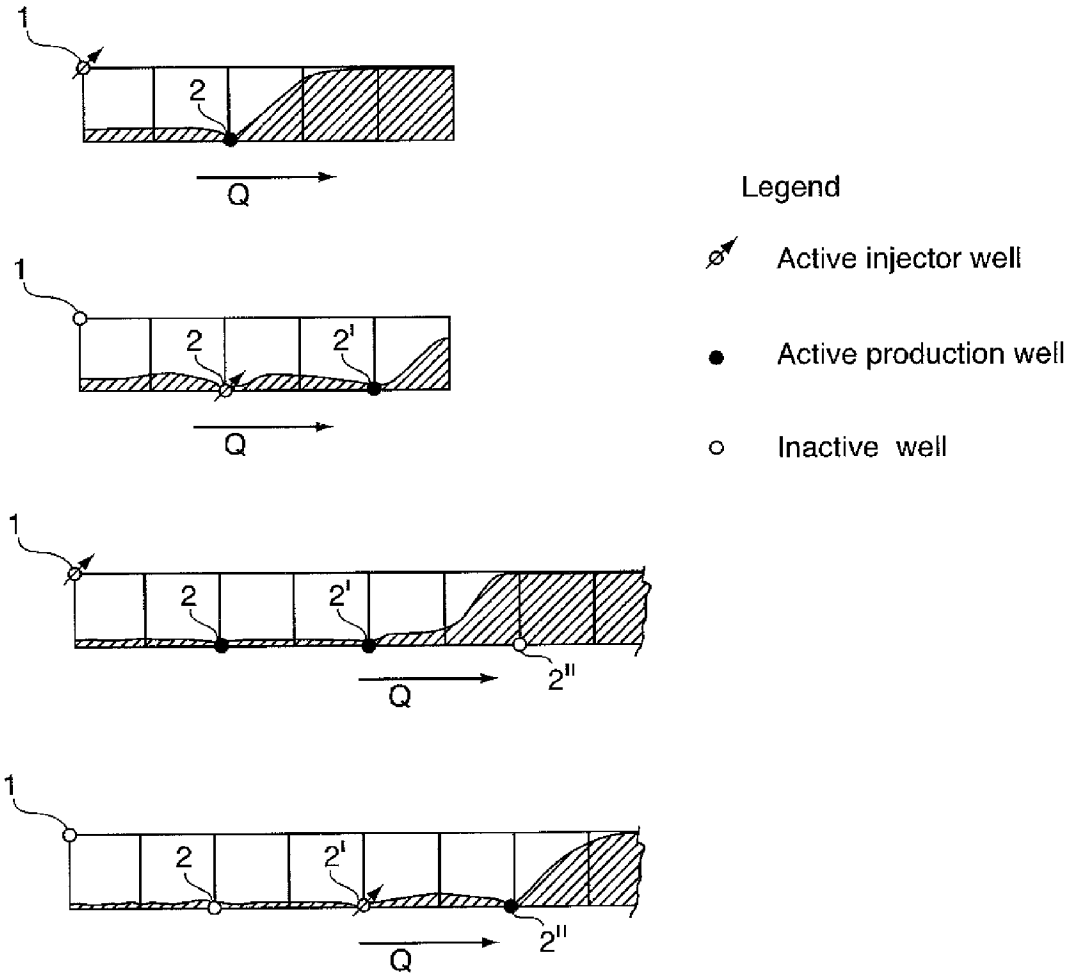
FIG. 4*c* (*i*)-(*iv*) are views on section B-B of FIG. 3, at successive time intervals, showing a further variation of the method of producing oil using such "horizontal well line drive" configuration, showing the steps for causing a line drive of oil recovery in the direction "Q"

FIGS. 4*a*-*c*, namely in various alternative sub-phases (i), (ii), (iii), and (iv) thereof, each show the residual oil in oil containing portion 20 which is remaining after each sub-phase of the method of the present invention, in shaded portion.

In a first phase of the method of the present invention [identical in each of various methods shown in FIG. 4*a* (*i*), FIG. 4*b*(*i*), and FIG. 4*c*(*i*)], gas is injected into horizontal well 1 and oil is produced via second horizontal well 2. In a second phase of the method of the present invention [shown in FIG. 4*a*, FIG. 4*b*, and FIG. 4*c* as step (ii)], a third horizontal well 2' is drilled low in the oil-containing portion 20 of reservoir 22, parallel to horizontal well 2 but laterally spaced apart therefrom, and spaced laterally further from first well 1 than from well 2, and production of oil carried out via well 2'. Upon the oil rate being produced from second horizontal well 2 diminishing to below an economical limit, production from such well 2 is ceased, and well 2 is then employed for gas injection, as shown in FIG. 4*a* (*ii*), FIG. 4*b*(*ii*), and FIG. 4*c*(*ii*). Gaseous injection via well 1 may continue during this phase, or may cease as shown in step (ii) of FIGS. 4 *a-c*.

Figure 7:
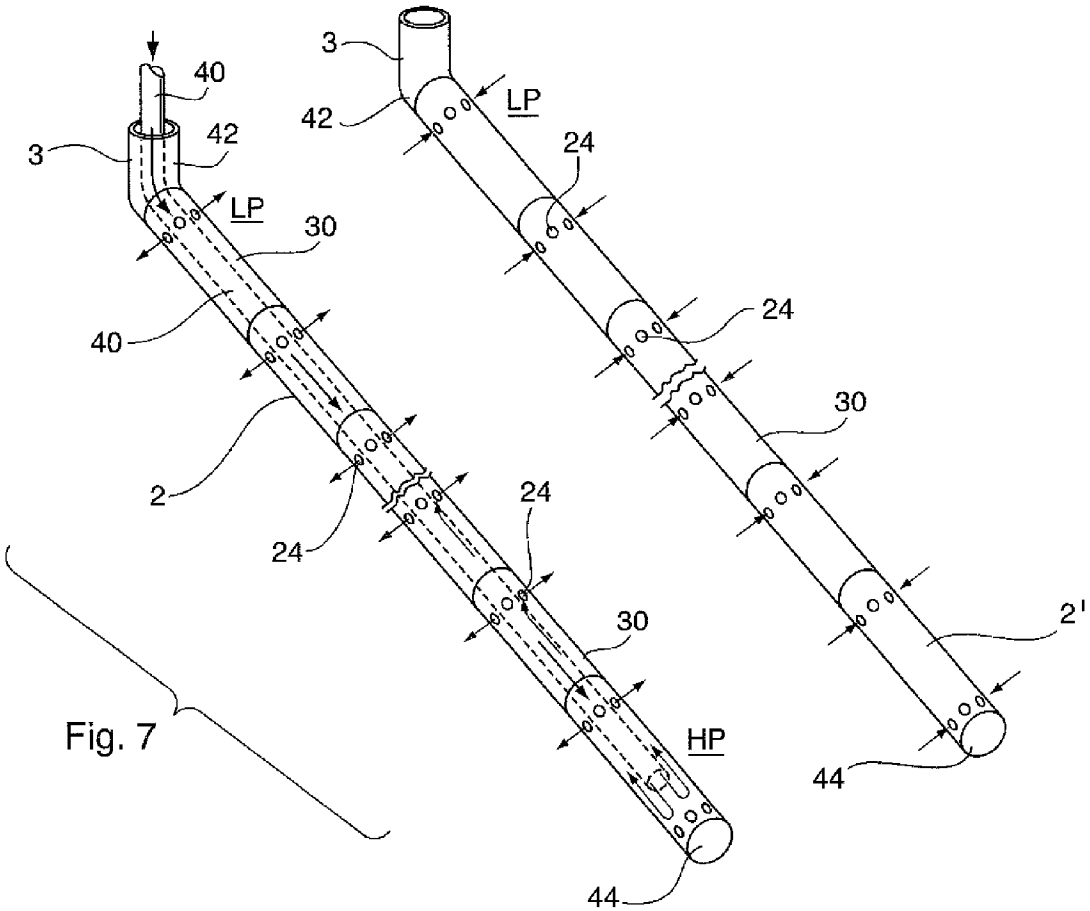
FIG. 7 is a view on a modification to the parallel, mutually adjacent but spaced-apart horizontal injection (production) wells of FIG. 6, showing two of such horizontal mutually-adjacent wells, wherein in a further embodiment tubing is used to deliver a medium such as an oxidizing gas to a "toe" (ie distal) end of the horizontal injection well.
Figure 8:
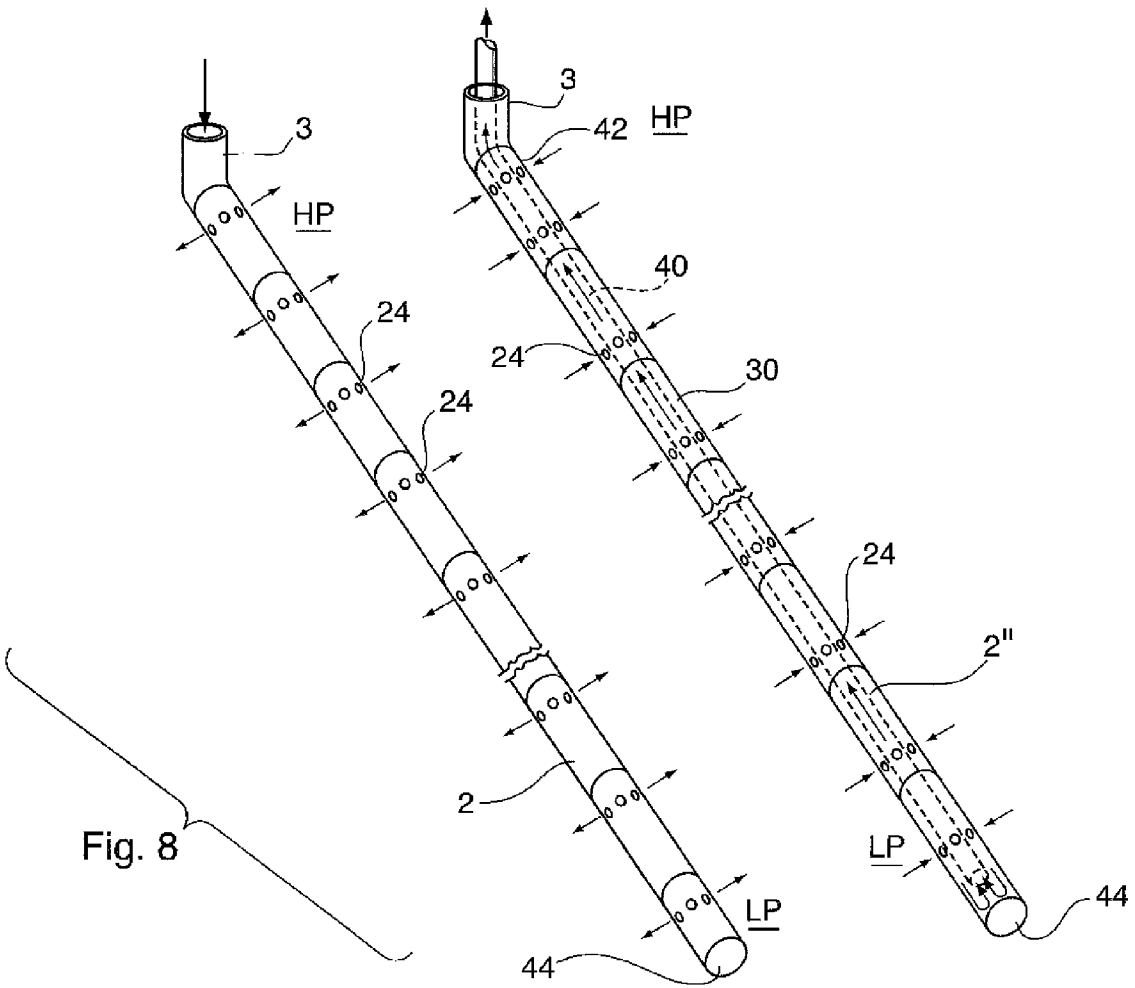
FIG. 8 is a view on a modification to the parallel, mutually adjacent but spaced-apart horizontal injection (production) wells of FIG. 6, showing two of such horizontal mutually-adjacent wells, wherein in a further embodiment tubing is used to recover oil from a "toe" (ie distal) end of the horizontal production well.

In a preferred embodiment, where vertical ends 3 of production well 2, 2' are on the same side of reservoir 22 as shown in FIG. 3, gas injection in second horizontal well 2 during this second phase is preferably via an internal tubing 40 extending from a proximal end (heel) 42 of third well 2' to the distal end (toe) 44 of well 2', with an open end thereof being at distal end 44 as shown in FIG. 7. Alternatively, if injection of gas into second well 2 is simply into a proximal end 42 of injection well 2' (ie no tubing 40 in injection well 2 during injection), then internal tubing 40 may instead be provided in adjacent third well 2' when such well 2' is acting as a production well, and oil is thereby drawn from toe portion 44 of such third well 2' via such tubing 40, as shown in FIG. 8. As explained above, each of the alternative configurations of FIG. 7 and FIG. 8 assist in avoiding "fingering" or "short circuiting of pressurized gas from injection well 2 directly to production well 2', when a configuration such as shown in FIG. 3 is used wherein each of the vertical portions 3 of production wells 2, 2', and 2''' are each on the same side of reservoir 22. As noted above, in this second phase a new parallel third well 2' is drilled low in the reservoir and placed on fluid production [see FIG. 4*a*(*ii*), FIG. 4*b*(*ii*) and FIG. 4*c*(*ii*)]. During this second phase a fourth horizontal well 2" may be drilled, as shown in FIG. 4*a*(*ii*) and production initiated from such well 2" as well as from well 2'. Alternatively only the drilling of well 2" may be conducted during this phase, with production from well 2" occurring during the third phase (discussed below) and as shown in FIG. 4*c*(*iii*) and (*iv*).

FIGS. 4*a*(*iii*), 4*b*(*iii*), and 4*c*(*iii*) each show slightly different third phases of the method of the present invention.

As regards the embodiment of the method disclosed in FIG. 4(*b*) (*iii*), when the rate of oil production from third well 2' being produced in step (ii) drops below a pre-determined limit, a drawdown phase is undertaken where gas is again injected in well 1. Well 2 is switched back to operating as a production well, and wells 2 and 2' are employed as production wells for a time to withdraw all remaining oil.

Thereafter the fourth well 2" may be drilled, and a similar process repeated wherein a former production well (well 2') is converted into an injection well 2', and production commenced from fourth well 2", while gas continues to be injected via well 1.

Alternatively, as regards the third phase shown in step (iii) of FIG. 4*a*, injection of gas from well 1 is ceased, with gas being injected into the reservoir 22 solely via such well 2' which as noted above is converted from a production well to an injection well. Fourth well 2" operates as a production well.

Alternatively, as shown in FIG. 4*c*(*iii*), injection of gas into well 1 may be re-instituted to completely drain all oil above wells 2 and 2', and a new fourth well 2" drilled. Only thereafter, when production from wells 2 and 2" is exhausted or substantially exhausted, is well 2' converted to an injector well and gas subsequently supplied to the formation via well 2' and production commenced from well 2" as shown in FIG. 4*c*(*iii.*

As noted above, where the vertical portions 3 of wells 2, 2', 2", 2''', and $2^{iv}$ are all situated on the same side of reservoir 22 (see FIG. 6) and not on alternating sides of reservoir 22, in order to reduce "fingering" between a mutually adjacent collector/production well and a mutually-adjacent injector well, tubing may be employed in the manner described above and as shown in FIG. 7 or 8.

Figure 9:
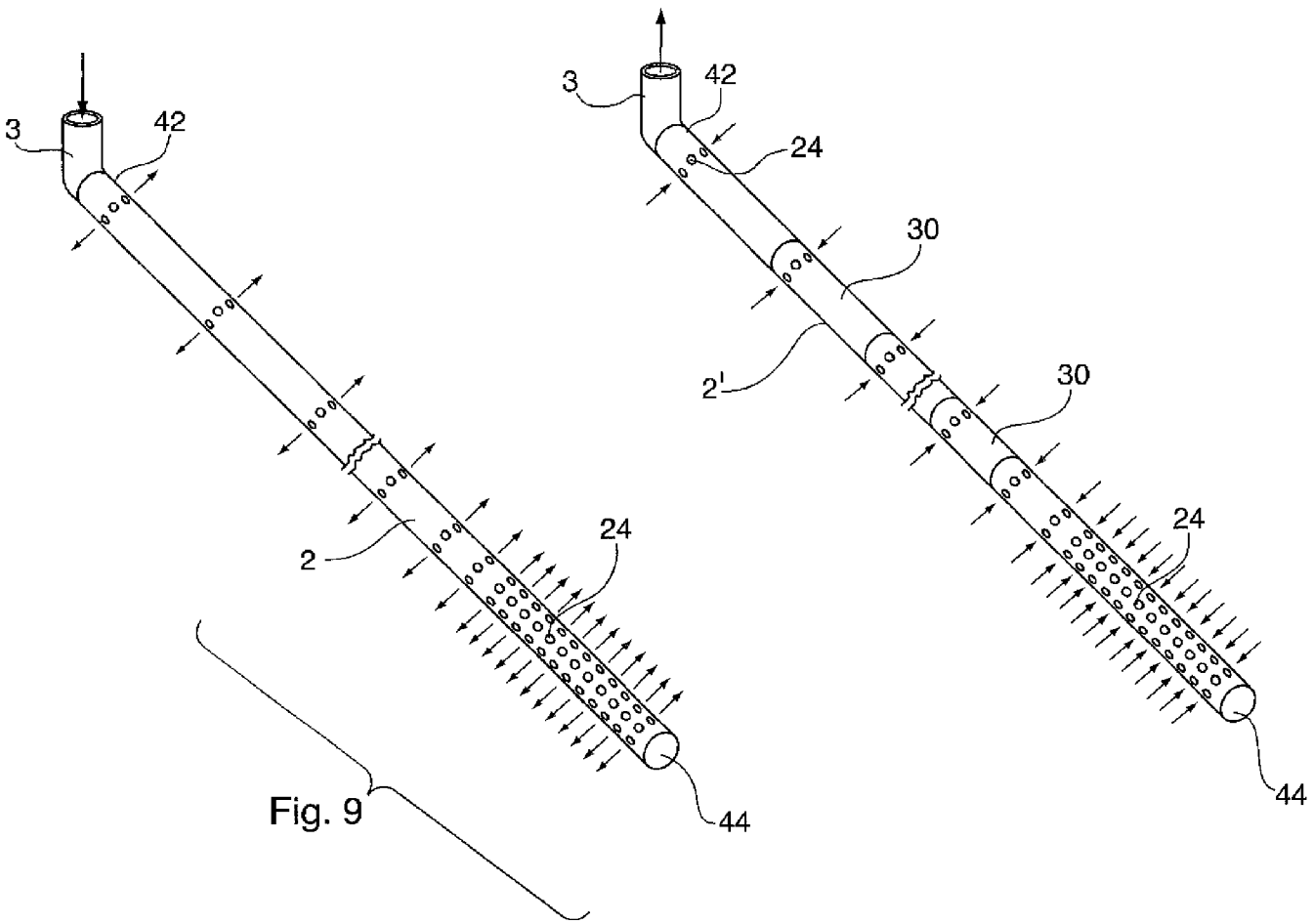
FIG. 9 is a view of an alternative modification to the parallel, mutually adjacent but spaced-apart horizontal injection (production) wells of FIG. 6, showing two of such horizontal mutually-adjacent wells, wherein apertures therein are more closely spaced and more numerous towards the "toe" (ie distal) end of each of such horizontal wells.

As an alternative configuration to reducing or avoiding the "fingering" or short-circuiting problem between an injector and mutually-adjacent production wells 2, 2', 2", 2''', $2^{iv}$ having respective vertical portions 3 of such wells on the same side of reservoir 22 as shown in FIG. 6 and to more uniformly inject gaseous medium such as oxidizing gas, steam, carbon dioxide, hydrocarbon diluents (in either gaseous or liquid form) in one embodiment shown in FIG. 9, the number of apertures 24 may be progressively made more numerous over the length of horizontal well 2, and similarly over the length of a mutually adjacent well 2', progressing from the proximal end 42 toward the distal end 44 of each of said wells 2, 2', 2", 2''', $2^{iv}$, and so forth.

Figure 10:
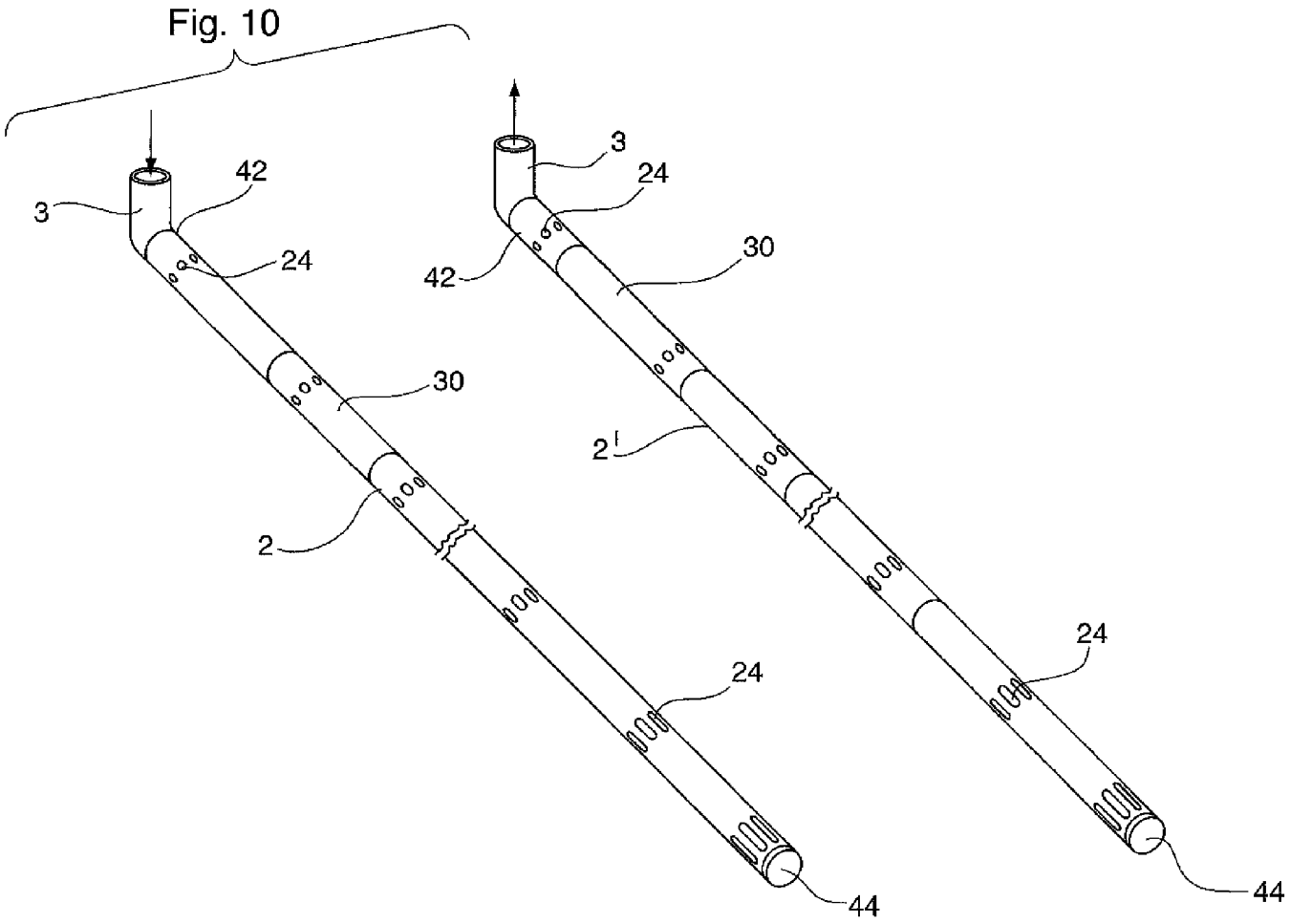
FIG. 10 is a view of a further alternative modification to the parallel, mutually adjacent but spaced-apart horizontal injection (production) wells of FIG. 6, showing two of such horizontal mutually-adjacent wells, wherein apertures therein are larger towards the "toe" (ie distal) end of each of such horizontal wells.

Alternatively, to likewise more uniformly inject gaseous medium such as oxidizing gas, steam, carbon dioxide, hydrocarbon diluents (in either gaseous or liquid form) along the length of an injector well (e.g. 2') and also to more uniformly collect oil along a length of a mutually adjacent collector well (e.g. 2"), in an embodiment shown in FIG. 10 the size of apertures 24 may be progressively be made larger over the length of each well 2, 2', 2", 2''', $2^{iv}$ and so forth and similarly over the length of a mutually adjacent well 2', progressively increasing in area from the proximal end 42 toward the distal end 44 of each of said wells 2, 2', 2", 2''', $2^{iv}$.

Figure 12:
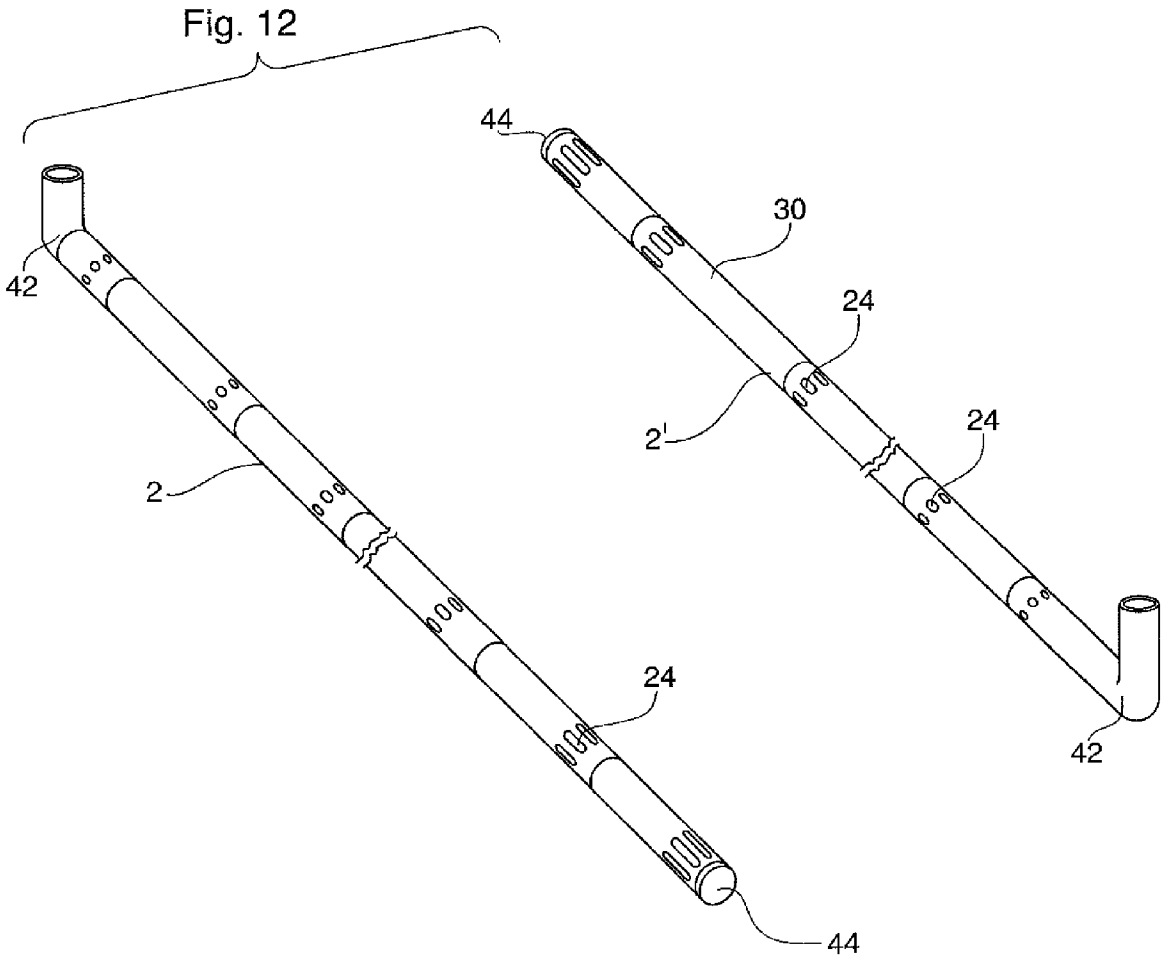
FIG. 12 is a view of a modification to the parallel, mutually adjacent but spaced-apart horizontal injection (production) wells of FIG. 11, showing two of such horizontal mutually-adjacent well, wherein apertures therein are larger towards the "toe" (ie distal) end of each of such horizontal wells.

Conversely, vertical portions 3 of mutually-adjacent wells 2, 2', 2", 2''', $2^{iv}$ and so forth may be situated on respective opposite sides of the reservoir 22 as shown in FIG. 11 to more uniformly inject gaseous medium such as oxidizing gas, steam, carbon dioxide, hydrocarbon diluents (in either gaseous or liquid form), and to collect oil via an adjacent well. To further and even better accomplish uniform injection of air and/or collection of oil, where adjacent wells are used respectively to inject air from one, and to collect oil from the other, in a further embodiment shown in FIG. 12 the number of apertures 24 in each of such wells may be progressively made more numerous over the length of each horizontal well (e.g. well 2), and similarly over the length of a mutually adjacent well (e.g. well 2'), progressing from the proximal end 42 toward the distal end 44 of each of said wells 2, 2', 2", 2''', $2^{iv}$, and so forth.

Figure 13:
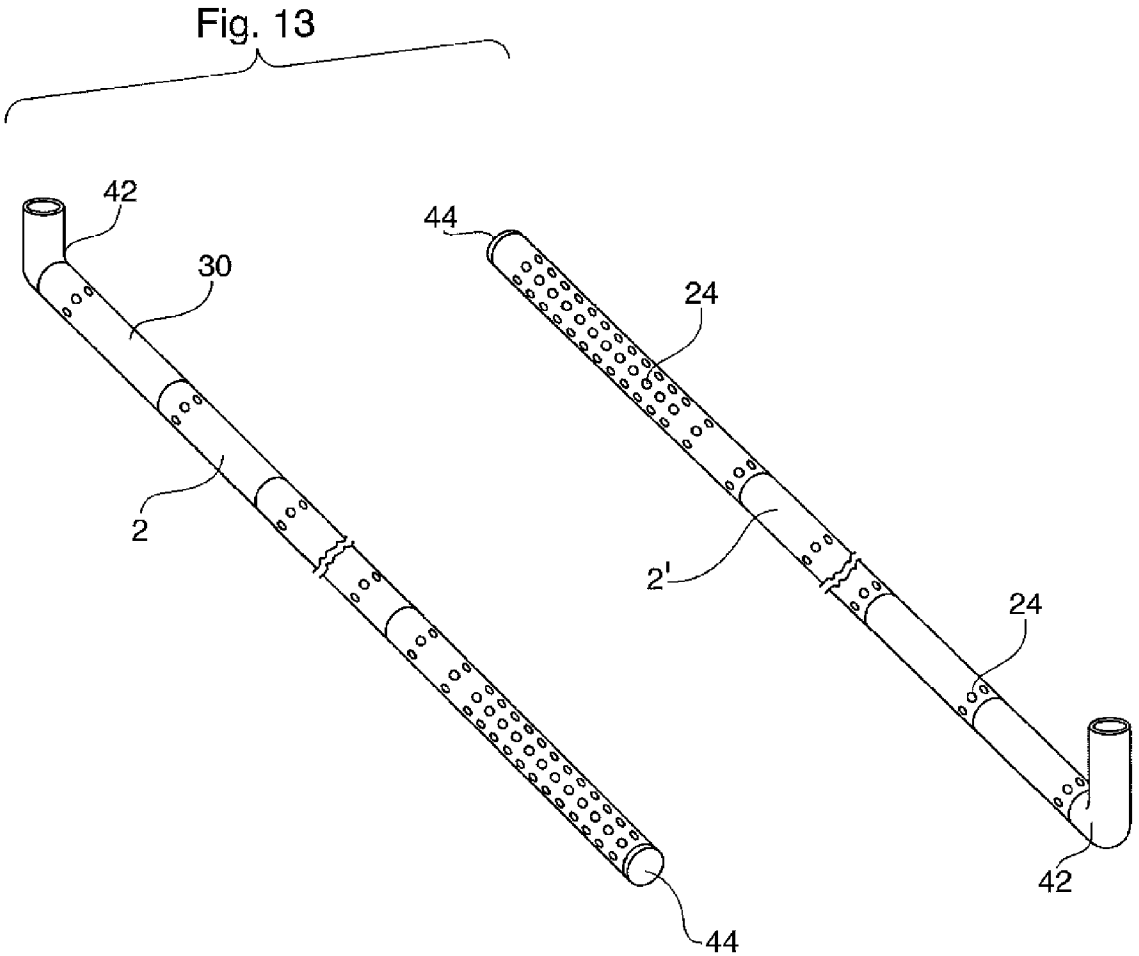
FIG. 13 is a view of a modification to the parallel, mutually adjacent but spaced-apart horizontal injection (production) wells of FIG. 11, showing two of such horizontal mutually-adjacent wells wherein apertures therein are more numerous and more closely spaced towards the "toe" (ie distal) end of each of such horizontal wells.

Alternatively, in an embodiment shown in FIG. 13 the size of apertures 24 may be progressively be made larger over the length of each well 2, 2', 2", 2''', $2^{iv}$ and so forth and similarly over the length of a mutually adjacent well 2', progressively increasing in area from the proximal end 42 toward the distal end 44 of each of said wells 2, 2', 2", 2''', $2^{iv}$, to achieve the same result of more even pressure distribution over the length of each of the respective wells 2, 2', 2", 2''', $2^{iv}$.

EXAMPLES

For the purpose of making a direct performance comparison of the "Staggered Well" configuration shown in FIGS. 1, 1*a*, and FIG. 2 and the HWLD process of the present invention shown in FIG. 3, FIG. 4*b*, & FIG. 6, and FIG. 11 computer modelling and simulation techniques as more fully described herein were used.

Specifically, extensive computer numerical simulation of each of the Staggered Well Pattern and HWLD, using an in situ combustion process for the recovery of mobile oil in a homogeneous reservoir, were undertaken using the STARS™ Thermal Simulator 2010.12 provided by the Computer Modelling Group, Calgary, Alberta, Canada. The modelling reservoir used in the Examples contained bitumen at elevated temperature (54.4° C.) with high rock permeability.

In each of the modelled Staggered Well well (FIGS. 1, 1*a*, and FIG. 2), and HWLD well configuration (FIG. 11, FIG. 4*b*), the oil-containing portion 20 of reservoir 22 is developed in three phases.

Specifically, for each of the Staggered Well Pattern shown in FIG. 1, the entire volume of FIG. 1 was exploited three times, once for each of the three phases. This requires a total of fifteen horizontal wells, as shown in FIG. 1A.

For the HWLD process, a first phase of which is shown in FIG. 3 and FIG. 4*b*, only part of the total reservoir volume is exploited, but after conducting two additional phases, in the end the same volume of reservoir 22 is exploited (namely 20 m×100 m×(50 m×15 blocks)=1,500,000 $m^3$) as with the Staggered Well Pattern process, but requiring a total of only 7.5 horizontal wells as opposed to fifteen wells for the Staggered Well well configuration as shown in FIG. 1*a*.

For combustion simulations with air the reactions used:

1. 1.0 Oil→0.42 Upgrade ($C_{16}H_{34}$)+1.3375 $CH_4$+29.6992 Coke
2. 1.0 Oil+13.24896 $O_2$→5.949792 $H_2O$+6.0 $CH_4$+9.5 $CO_2$+0.5 CO/N2+27.3423 Coke
3. 1.0 Coke+1.2575 $O_2$→0.565 $H_2O$+0.95 $CO_2$+0.05 CO/N2

Table 1 below sets out the modelled reservoir properties, oil properties and well control for each of the Staggered Well Offset configuration and HWLD configuration:

TABLE 1

| Parameter | Units | Value |
|---|---|---|
| Reservoir Properties | | |
| Pay thickness | m | 20 |
| Porosity | % | 30 |
| Oil saturation | % | 80 |
| Water saturation | % | 20 |
| Gas mole fraction | fraction | 0.263 |
| H. Permeability | mD | 5000 |
| V. Permeability | mD | 3400 |
| Reservoir temperature | ° C. | 54.4 |
| Reservoir pressure | kPa | 3000 |
| Rock compressibility | /kPa | 3.5E−5 |
| Conductivity | J/m · d · C. | 1.5E+5 |
| Rock Heat capacity | J/$m^3$-C. | 2.35E+6 |
| Oil Properties | | |
| Density | Kg/$m^3$ | 1009 |
| Viscosity, dead oil @ 20 C. | cP | 77,000 |
| Viscosity, in situ | cP | 1139 |
| Average molecular weight oil | AMU | 598 |
| Average molecular weight Upgrade | AMU | 224 |
| Oil mole fraction | Fraction | 0.737 |
| Compressibility | /kPa | 1.06E+3 |
| The wells were controlled using the following parameters: | | |
| Maximum air injection pressure | kPa | 7000 |
| Horizontal well length | m | 100 |
| Producer BHP minimum | kPa | 2600 |
| Total air injection rate | $Sm^3$/d | 50,000 |

The transmissibility of the oil production wells was varied monotonically along the well from 1.0 at the toe to 0.943 at the heel, in order to improve sweep efficiency.

Example 1

Staggered Well Configuration

For the Staggered Well configuration, the oil containing portion 20 of reservoir 22 comprising grid blocks 50*a*-50*o* shown in FIG. 1A was s divided into three equal parts, each consisting of five grid blocks 50*a*-*e*, 50 *f*-*j*, and 50*k*-*o*, as shown in FIG. 1. Each equal part was successively exploited in three separate but successive phases, each phase taking 5 years, using the wells in FIG. 1 over a 15-year period. The total reservoir volume exploited over the 15-years process life is 1,500,000 $m^3$.

For the Staggered Well Pattern shown in FIG. 1, a first part of the three part modelling used 2.5 injection wells 1, 1', and 1", and 2.5 production wells 2, 2', and 2", all simultaneously drilled, for a total of five wells. The reservoir thickness 4 was 20 m and the well offset was 50 m for each grid block 50*a*-50*o*. Air injection rates were 10,000 $m^3$/d for well 1 and 20,000 $m^3$/d for each of injectors 1' and 1", for a total of 50,000 $m^3$/d for the pattern.

For the computer modelling of the Staggered Well pattern the first phase comprised grid blocks 50*a*-50*e*. A second pattern comprised an identical pattern (grid blocks 50*f*-50*j*), modelled as exploited over a further 5-years and in a third phase (grid blocks 50*k*-50*o*) comprised another identical pattern which was modelled as being exploited over a final 5-years. The reservoir volume of each part was 500,000 $m^3$ for a total field exploitation volume of 1,500,000 $m^3$ (i.e. 3×100 m×250 m×20 m) over 15-years. The final oil recovery factor was 79% of original oil in place. A summary of results is shown in Table 2 and FIG. 5.

Example 2

HWLD Well Configuration

For the HWLD process which was modelled using computer simulation, and as shown in FIG. 4*b*, in a first phase (FIG. 4*b*(*i*)] a horizontal injector well 1 is located high in the formation, and a horizontal well 2 located low in the reservoir 22 is provided, both being placed along one side of the oil containing portion 20 of reservoir 22.

In FIG. 4*b* and FIG. 11, representing the HWLD process and configuration of the method of the present invention, the well lengths 6 were each 100 m, the reservoir thickness, 4, was 20 m and the well offset was 100 m. The total volume of reservoir produced over the 15-year exploitation period was thus also 1,500,000 $m^3$.

The air injection rate was 16,667 $m^3$/d for each of the injectors for a total of 50,000 $m^3$/d throughout Phase 1.

In a second phase [FIG. 4*b*(*ii*)], after 5-years, the oil production rate per producer fell to 13 $m^3$/d, which was considered uneconomical, and a second phase [FIG. 4*b*(*ii*)] conducted, namely the original producer well 2 was converted as shown in FIG. 4*b*(*ii*) to an air injector by injecting steam at 270° C. for 2-weeks to flush out wellbore oil and then air was injected through the wellbore tubing at 26,000 $m^3$/d. At the same time, a second producer well 2' was drilled as shown in FIG. 4*b*.

After 5-years, a final drawdown phase (FIG. 4*b*(*iii*)] was begun, with air injection at 7,333 $m^3$/d into the original injector well 1, while both the producers 2 and 2' were put on production. The total field exploited volume was 1,500,000 $m^3$ (i.e. 3×100 m×250 m×20 m) over 15 years. The final oil recovery factor was 79% of original oil in place.

Comparison and Proven Advantages

A summary of comparative results of each of Examples 1 & 2 is shown in Table 2 below.

TABLE 2

| | | Phase 1 [FIG. 4b(i)] | Phase 2 [FIG. 4b(ii)] | Phase 3 [FIG. 4b(iii)] | Total |
|---|---|---|---|---|---|
| Time (years) | | 5 | 5 | 5 | 15 |
| # New Wells for | Staggered* | 5 | 5 | 5 | 15.0 |
| each Phase | HWLD | 4.5 | 3.0 | 0 | 7.5 |
| Air Rate, | Staggered* | 50 | 50 | 50 | — |
| $m^3/d \times 10^3$ | HWLD | 50 | 78 | 22 | — |
| Cumulative Air, | Staggered* | 91.25 | 91.25 | 91.25 | 274 |
| $m^3 \times 10^6$ | HWLD | 91.25 | 142.35 | 40.15 | 274 |
| Cumulative Oil, | Staggered* | 95,126 | 95,126 | 95,126 | 285,378 |
| $m^3$ | HWLD | 133,278 | 125,646 | 26,646 | 285,570 |
| Cumulative | Staggered* | 959 | 959 | 959 | 959 |
| Air-Oil Ratio, $m^3/m^3$ | HWLD | 685 | 1133 | 1507 | 959 |

*Not part of the invention claimed herein

The significant and important differences in the two methods are shown in grey.

Figure 5:
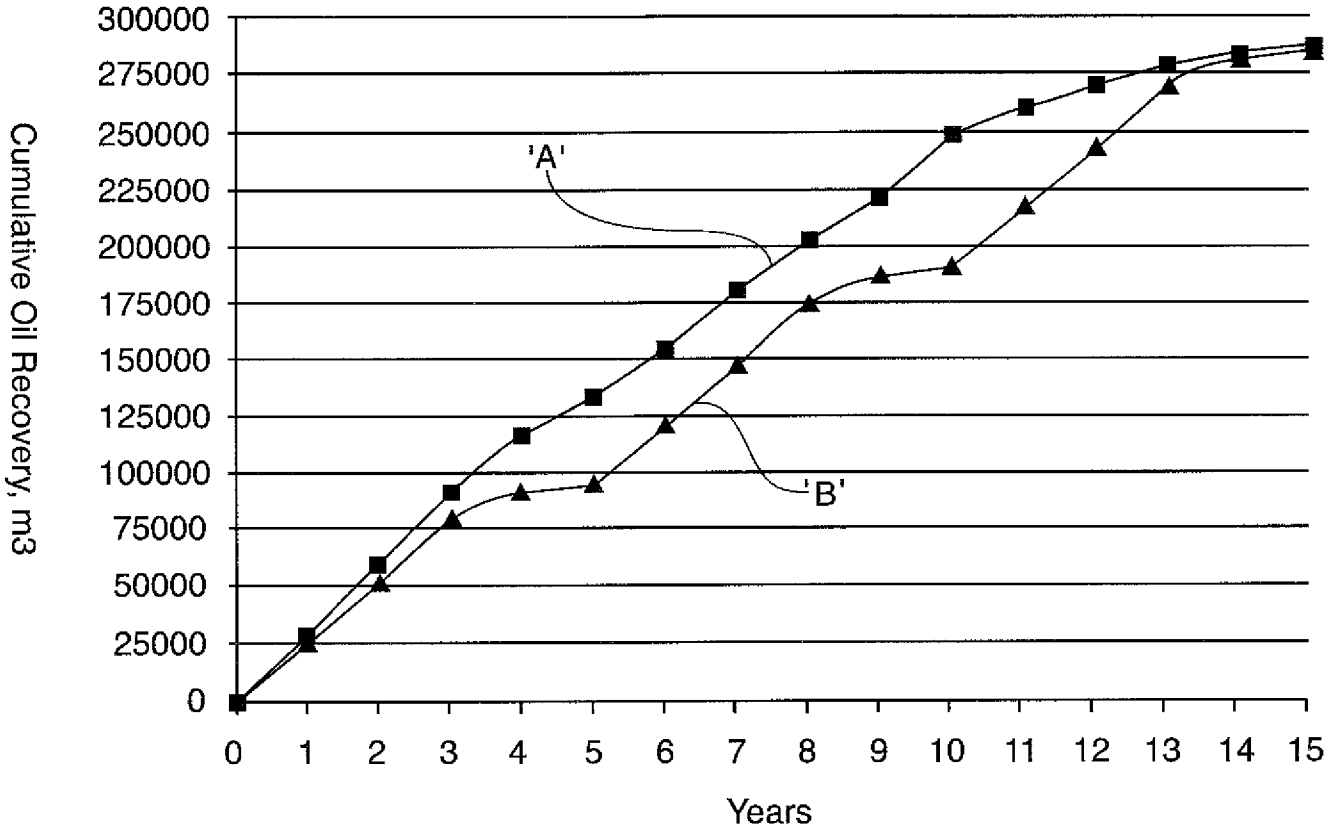
FIG. 5 is a graph of cumulative oil recovery versus time (years), comparing cumulative oil recovery of the "staggered well" method of recovery shown in FIGS. 1 & 2 (line "B" of FIG. 5), to the cumulative oil recovery obtained using the "horizontal well line drive" method of the present invention shown in FIG. 4*b* (*i*)-(*iii*), for a reservoir having the horizontal well locations and configuration shown in FIG. 11 (line "A" of FIG. 5)

Specifically, FIG. 5 shows the Cumulative Oil Recovery over time for each of the Staggered Well configuration (triangles-line 'B") and the HWLD well configuration (squares-line 'A').

Referring to Table 2 and FIG. 5, the HWLD for production of mobile oil is advantageous over the Staggered Well process even in a homogeneous reservoir for at least the following two reasons.

Firstly, only half the number of horizontal wells (7.5 wells, as compared to 15 wells) are needed for the same compressed air volume and cumulative oil rates are substantially higher over most of the life of the process.

Secondly, the cumulative oil recovery for the HWLD process as compared to the Staggered Well process is initially higher, resulting in a higher initial return on investment. Specifically in this regard, as may be seen from FIG. 5 herein, at the end of Phase 1 (5-years), the cumulative oil (133.278 $m^3$) is 40% higher than that initially covered in the Staggered Well method (95.126 $m^3$). At the end of Phase 2 (10-years) cumulative oil recovered using the HWLD process is 30% higher (125.646 $m^3$ as compared to quantum recovered using the Staggered Well method described above (95.126 $m^3$). As the HWLD process is a line-drive process, the reservoir fluids flow in a single direction, which improves reservoir sweep in reservoirs with lateral heterogeneity.

The scope of the claims should not be limited by the preferred embodiments set forth in the foregoing examples, but should be given the broadest interpretation consistent with the description as a whole, and the claims are not to be limited to the preferred or exemplified embodiments of the invention.

The invention claimed is:

1. A method for recovering oil from a hydrocarbon-containing subterranean reservoir, comprising the steps of:

(i) drilling a first horizontal well, situated relatively high in said reservoir;

(ii) drilling a second horizontal well, situated relatively low in said reservoir and aligned substantially parallel to said first horizontal well;

(iii) injecting a first medium comprising a gas, steam, or a liquid into said reservoir via apertures in said first horizontal well;

(iv) withdrawing oil which moves downwardly in said subterranean reservoir and flows into said second horizontal well, from said second horizontal well;

(v) drilling a third horizontal well, relatively low in said reservoir and substantially parallel to said first and second horizontal wells but laterally spaced apart therefrom, laterally spaced farther from said first horizontal well than from said second horizontal well;

(vi) temporarily or permanently ceasing withdrawing hydrocarbons from said second horizontal well;

(vii) proceeding to inject a second medium comprising a gas, steam, or a liquid into said second horizontal well; and (ix) withdrawing oil which moves downwardly in said subterranean reservoir into said third horizontal well, from said third horizontal well.

2. The method for recovering oil from a hydrocarbon-containing subterranean reservoir as claimed in claim 1 for sweeping a substantial volume of oil from within a hydrocarbon-containing reservoir by progressing in a generally linear direction along said formation, comprising additional repeated steps including:

successively drilling additional horizontal wells low in said reservoir substantially parallel to and substantially co-planar with said third horizontal well but laterally spaced apart therefrom and from each other; and successively converting a penultimate well of said additional horizontal wells from a production well to an injection well by thereafter injecting said gas, steam, or a liquid into said penultimate well so as to cause oil in said reservoir to move from within said reservoir downwardly into a last of said additional horizontal wells.

3. The method for recovering oil from a hydrocarbon-containing subterranean reservoir as claimed in claim 1, wherein said first medium and said second medium are the same medium.

4. The method for recovering oil from a hydrocarbon-containing subterranean reservoir as claimed in claim 3, wherein said first medium comprises oxygen gas, air, or mixtures thereof for the purpose of conducting in situ combustion, said method further comprising the step, after step (iii), of igniting said hydrocarbons in said reservoir in a region proximate said first horizontal well, and withdrawing combustion by-products and said oil from said subterranean formation via said second horizontal well and/or via said third horizontal well.

5. The method as claimed in claim 4, wherein the gas is CO2, light hydrocarbons, or mixtures thereof.

6. The method for recovering oil from a hydrocarbon-containing subterranean reservoir as claimed in claim 4, further comprising the further step of causing a combustion front to move laterally from said first horizontal well in the direction of said second and third horizontal wells, thereby heating oil in said reservoir and causing said oil to drain downwardly for collection.

7. The method as claimed in claim 1, wherein said first medium and said second medium is a gas which is soluble in oil.

8. The method for recovering oil from a hydrocarbon-containing subterranean reservoir as claimed in claim 1 wherein said step (iii) of injecting a gas, steam, or liquid into said first horizontal well comprises the step of injecting said gas, steam, or liquid into one end of said first horizontal well, and said step of withdrawing oil from said second horizontal well comprises the step of withdrawing said oil from one end of said second horizontal well, said one end of said second horizontal well situated on a side of said reservoir opposite a side of said reservoir at which said one end of said first horizontal well is situated.

9. The method for recovering oil from a hydrocarbon-containing subterranean reservoir as claimed in claim 1, wherein said step (vi) of injecting said gas, steam, or liquid into said second horizontal well comprises injecting said gas, steam, or liquid into an end of said second horizontal well situated on a side of said reservoir opposite an end of said third horizontal well from which said oil is collected from.

10. The method for recovering oil from a hydrocarbon-containing subterranean reservoir as claimed in claim 1, wherein said step (vi) of injecting said gas, steam, or liquid into said second horizontal well comprises injecting said gas, steam, or liquid into a first end of said second horizontal well, said first end of said second well situated on a same side of said reservoir at which a first end of said third horizontal well from which said oil is collected from is situated.

11. The method for recovering oil from a hydrocarbon-containing subterranean reservoir as claimed in claim 10, wherein said second horizontal well has a plurality of apertures therein, wherein a size of said apertures or a number of said apertures progressively increases from a first end to a second end of each of said second and third horizontal wells.

12. The method for recovering oil from a hydrocarbon-containing subterranean reservoir as claimed in claim 10, wherein said third horizontal well has a plurality of apertures therein, wherein a size of said apertures or a number of said apertures progressively increases from said first end to a second end thereof.

13. The method for recovering oil from a hydrocarbon-containing subterranean reservoir as claimed in claim 10, wherein each of said second well and said third well have a plurality of apertures therein, wherein a size of said apertures or a number of said apertures progressively increases from said first end thereof to a second thereof.

14. The method for recovering oil from a hydrocarbon-containing subterranean reservoir as claimed in claim 1, wherein said oil is collected from a first end of each of said second and third horizontal wells, said first end of each of said second and third horizontal wells located on a same side of said reservoir, and said step (vi) of injecting said gas, steam, or liquid into said second horizontal well comprises injecting said gas, steam, or liquid into a second end of said second well via tubing, which tubing extends substantially from said first end to said second end of said second well.

15. The method for recovering oil from a hydrocarbon-containing subterranean reservoir as claimed in claim 1, a first end of each of said second and third horizontal wells located on a same side of said reservoir, and said step (vi) of injecting said gas, steam, or liquid into said second horizontal well comprises injecting said gas, steam, or liquid into said first end of said second well, and said step of withdrawing oil from said third well comprises withdrawing such oil from a second end of said third well via tubing, said tubing extending from said first end to substantially said second end of said third well.

16. The method for recovering oil from a hydrocarbon-containing subterranean reservoir as claimed in claim 1, each of said second horizontal well and said third horizontal well having a distal end and a proximal end, said proximal end of said second horizontal well and said proximal end of said third horizontal well being situated on mutually opposite sides of said reservoir.

17. The method for recovering oil from a hydrocarbon-containing subterranean reservoir as claimed in claim 1, wherein said first horizontal well possesses a plurality of apertures along substantially a length of said first horizontal well, and said step of injecting a gas, steam or liquid into said first horizontal well comprises the step of injecting said gas, steam, or liquid into said reservoir via said apertures in said first horizontal well.

18. The method or recovering oil from a hydrocarbon-containing subterranean reservoir as claimed in claim 17, wherein said first horizontal well has a well liner in which said plurality of apertures are situated, and wherein a size of said apertures or a number of said apertures within said liner within said first horizontal well progressively increases from a first end to a second end of said first horizontal well, and said gas, steam or liquid is injected into said first end of said first well.

19. The method for recovering oil from a hydrocarbon-containing subterranean reservoir as claimed in claim 1, wherein each of said second horizontal well and said third horizontal well have a plurality of apertures therein, wherein a size of said apertures or a number of said apertures progressively increases from a first end to a second end of each of said second and third horizontal wells.

20. The method as claimed in claim 1, further including the step, after step (v) or (vi), of ceasing injecting said gas, steam, or liquid into said first horizontal well after recovery of oil from said second horizontal well has fallen to a pre-determined fraction of a maximum recovery rate.

21. The method for recovering oil from a hydrocarbon-containing subterranean reservoir as claimed in claim 1 wherein said second horizontal well possesses a plurality of apertures along substantially a length of said second horizontal well, and said step of injecting a gas, steam or liquid into said second horizontal well comprises the step of injecting said gas, steam, or liquid into said reservoir via said apertures in said second horizontal well.

22. A line-drive method for recovering oil from a hydrocarbon-containing subterranean reservoir, comprising the steps of:

(i) drilling a first horizontal well relatively high in said reservoir, having a plurality of apertures therein;

(ii) drilling a second horizontal well relatively low in said reservoir and substantially parallel to said first horizontal well;

(iii) injecting an oxidizing gas into said first horizontal well and into said reservoir via said apertures therein, (iv) igniting hydrocarbons in said reservoir and conducting in situ combustion in said reservoir;

(v) withdrawing oil which drains downwardly in said subterranean reservoir into said second horizontal well from said second horizontal well;

(vi) drilling a third horizontal well, relatively low in said reservoir and substantially parallel to said second horizontal well but laterally spaced apart therefrom and laterally spaced from said first injection well farther than from said second horizontal well;

(vii) temporarily or permanently ceasing producing hydrocarbons from said second horizontal well, and converting said second horizontal well into an injection well;

(viii) injecting an oxidizing gas into said second horizontal well; and (ix) withdrawing oil which drains downwardly in said subterranean reservoir into said third horizontal well, from said third horizontal well;

(x) successively drilling additional horizontal wells low in said reservoir substantially parallel to and substantially co-planar with said third horizontal well but laterally spaced apart therefrom and from each other; and (xi) successively converting a penultimate of said additional horizontal wells from a production well to an injection well and injecting a gas, steam, or a liquid into said penultimate horizontal well so as to cause oil in said reservoir to move from within said reservoir downwardly into a last of said additional horizontal wells.

23. The method for recovering oil from a hydrocarbon-containing subterranean reservoir as claimed in claim 22, wherein a volume of gas, steam, or liquid injected into said subterranean reservoir is approximately equal to volume of oil recovered from said horizontal wells located low in the reservoir.

* * * * *